US006003652A

United States Patent [19]

Murata et al.

[11] Patent Number: 6,003,652

[45] Date of Patent: Dec. 21, 1999

[54] CASH DISPENSER

[75] Inventors: Susumu Murata; Tetsuji Kawasaki; Toshinori Henmi, all of Tokyo, Japan

[73] Assignee: Fuji Electric Co., Ltd., Kawasaki, Japan

[21] Appl. No.: 09/000,782

[22] Filed: Dec. 30, 1997

[51] Int. Cl.[6] ..... G07F 7/04; B07C 5/06; G07D 3/00; G07D 1/06

[52] U.S. Cl. ..... 194/206; 209/534; 453/11; 453/57

[58] Field of Search ..... 194/206, 207; 235/379; 209/534; 453/3, 4, 7, 11, 57

[56] References Cited

U.S. PATENT DOCUMENTS

| | | | |
|---|---|---|---|
| 4,733,765 | 3/1988 | Watanabe | 194/206 |
| 5,076,441 | 12/1991 | Gerlier | 209/534 |
| 5,911,622 | 6/1999 | Kinoshita et al. | 453/11 |

*Primary Examiner*—Robert P. Olszewski
*Assistant Examiner*—Bryan Jaketic
*Attorney, Agent, or Firm*—Kanesaka & Takeuchi

[57] ABSTRACT

A money receiving-paying machine of an integral structure includes a thin compact circulation type bill receiving-paying process portion and a thin compact circulation type coin receiving-paying process portion aligned side by side. The circulation type bill receiving-paying process portion includes a circulation type bill housing portion for sequentially housing bills regardless of their denominations, and a returning-bill transferring path for returning a bill to the circulation type bill housing portion by a first changeover gate when a bill has been identified as not necessary even if the bill is discharged in circulation. The bills are transferred in a bill short-side direction. The circulation type bill receiving-paying process portion includes rotation type coin receiving cylinders according to denominations positioned in an inclined bill or substantially horizontal state, so that upright coins can be housed therein in an orderly stacked state. The money receiving-paying machine is significantly thinner and compact so as to have the same dimension as that of a cash drawer box.

21 Claims, 29 Drawing Sheets

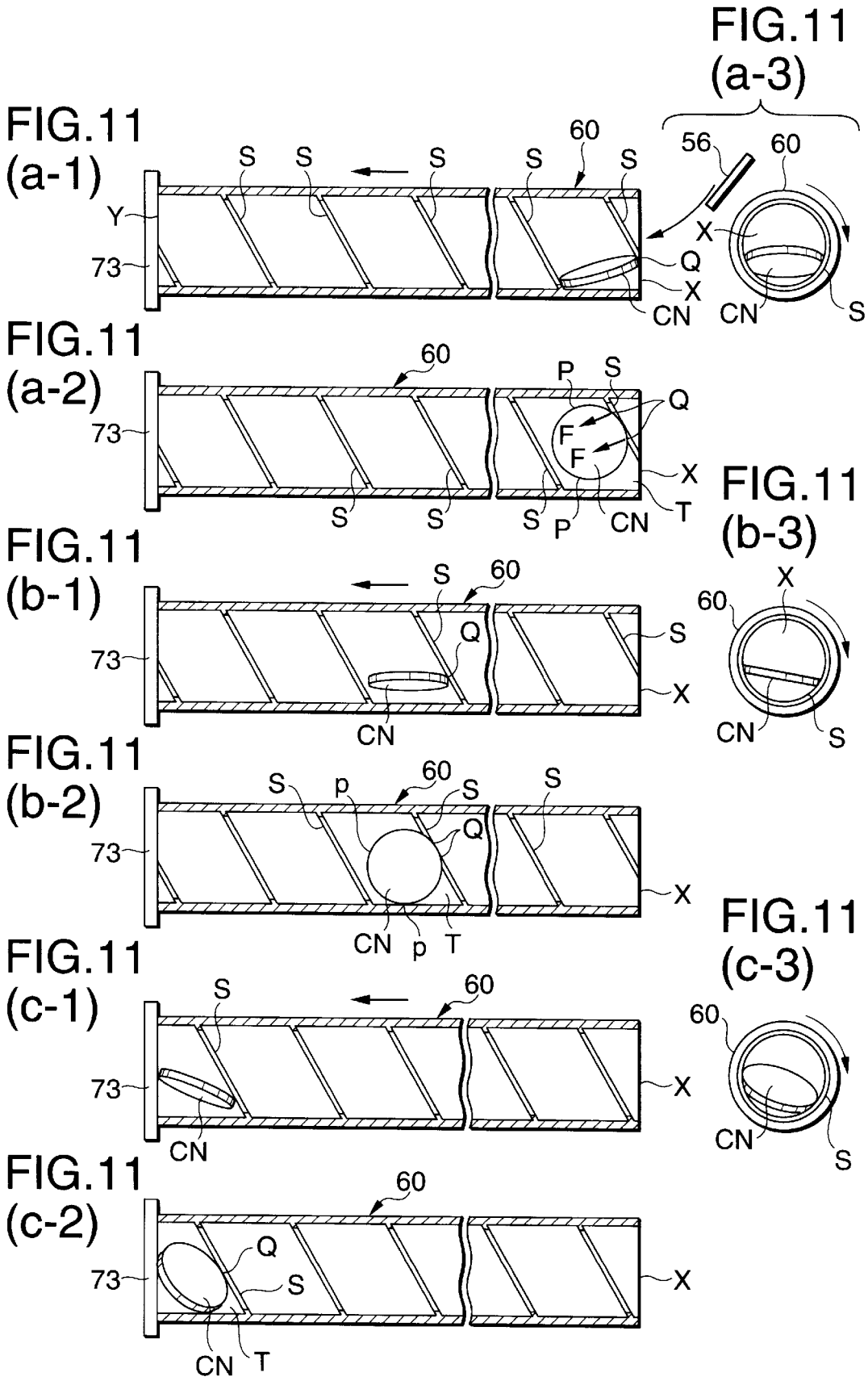
FIG.11 (a-1)
FIG.11 (a-2)
FIG.11 (a-3)
FIG.11 (b-1)
FIG.11 (b-2)
FIG.11 (b-3)
FIG.11 (c-1)
FIG.11 (c-2)
FIG.11 (c-3)
60
56
S
Y
73
Q
X
CN
P
F
T
p

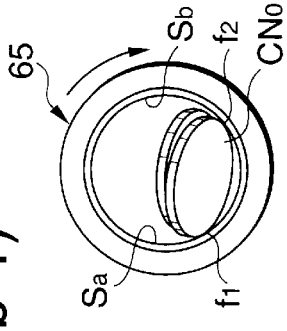
FIG.15(b-1)
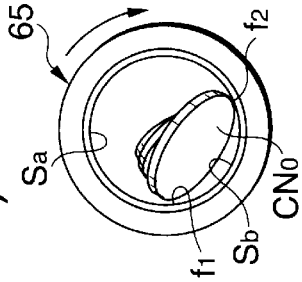
FIG.15(b-2)
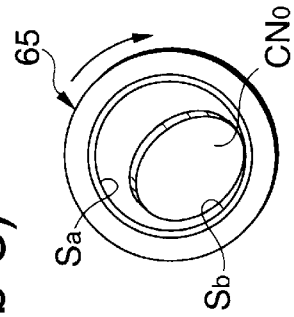
FIG.15(b-3)
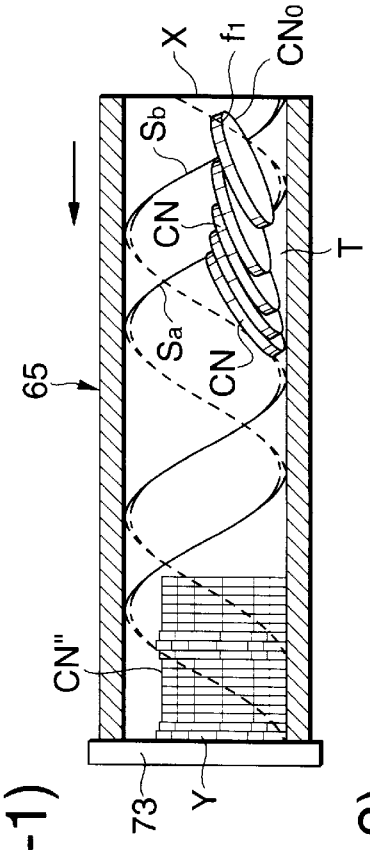
FIG.15(a-1)
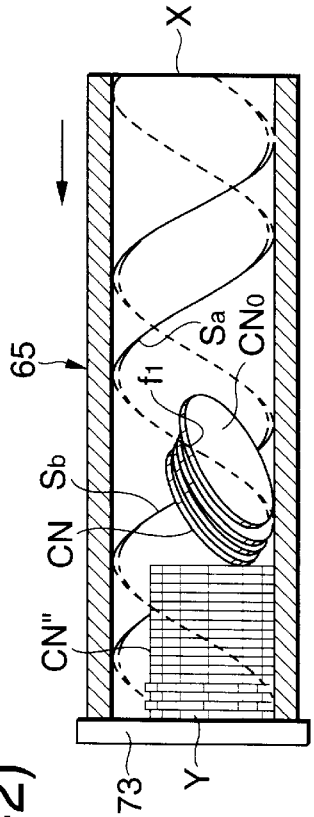
FIG.15(a-2)
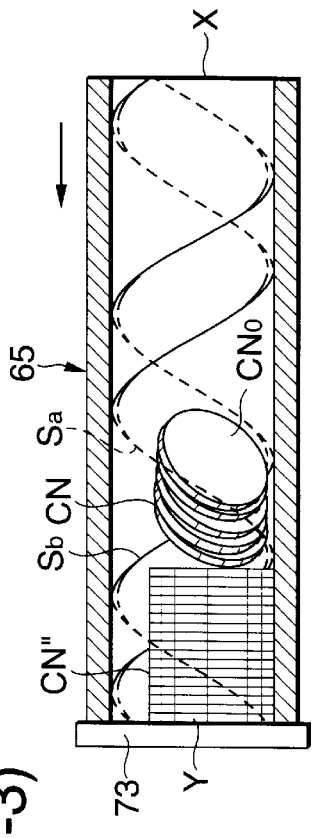
FIG.15(a-3)

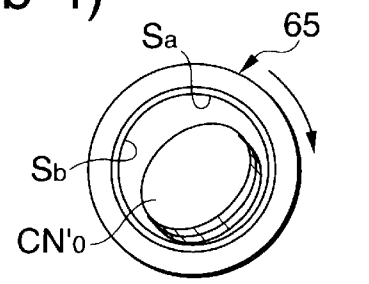
FIG.16(b-4)
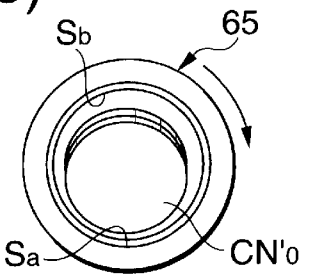
FIG.16(b-5)
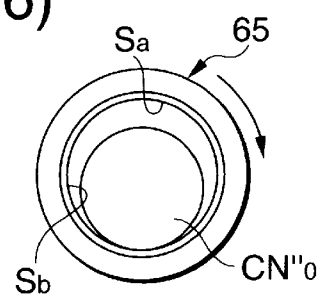
FIG.16(b-6)
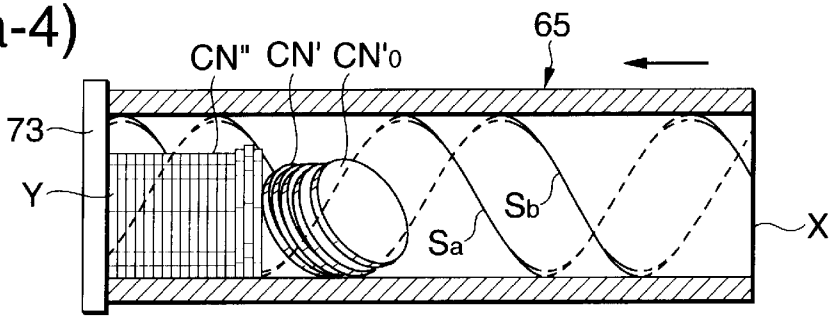
FIG.16(a-4)
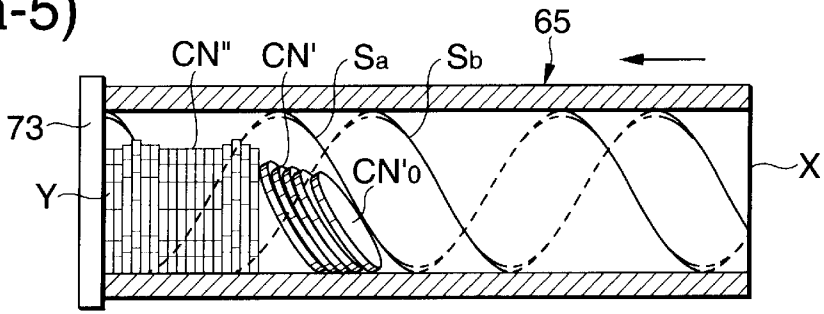
FIG.16(a-5)
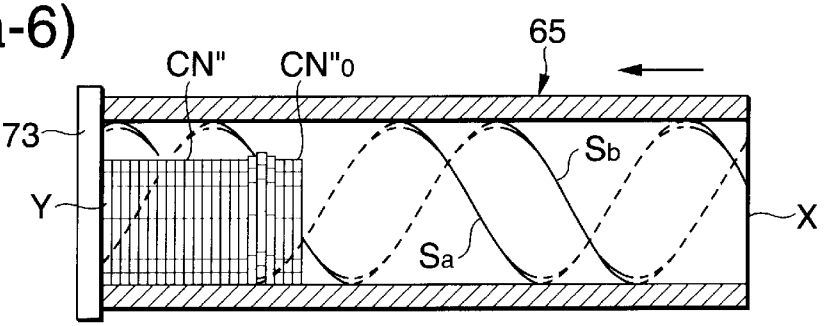
FIG.16(a-6)

CASH DISPENSER

BACKGROUND OF THE INVENTION AND RELATED ART STATEMENT

This invention relates to a money receiving-paying machine which can be used in connection with an electronic cash register, a register for POS or the like to be installed at a counter of a supermarket and a convenience store, or at a gas station, more particularly, an integral type compact bill and coin receiving-paying machine including a circulation type bill receiving-paying process portion where bills processed as received bills are reused as payments for changes and a circulation type coin receiving-paying process portion where coins processed as received coins are reused as payments for changes.

Recently, the register for POS (information management system at a point of sales) has been installed at a counter of a supermarket, convenience store or the like. As shown in FIG. 28, a cash drawer type POS register 10 includes a POS terminal 11 installed on a thin cash drawer box 12 having a drawer 12*a* with receiving chambers for receiving bills and coins of different denominations.

On the other hand, as shown in FIG. 29, in a POS register 18, an automatic change dispenser (money receiving-paying machine) 16 has been built therein. The automatic change dispenser 16 includes a circulation type bill receiving-paying device 14 to be installed on a floor and mounted in a receiving rack 15 having a height of a waist, and a circulation type coin receiving-paying device 13 installed on an upper plate of the receiving rack 15. Since the circulation type bill receiving-paying device 14 is generally installed on a floor, it has been impossible to install the cash drawer type POS register 10 as shown in FIG. 28 on a desk.

As an example of the automatic change dispenser installed on a desk, an integral type bill and coin receiving-paying machine has been known. The integral type bill and coin receiving-paying machine has a two-layer structure of a circulation type coin receiving-paying process portion and a circulation type bill receiving-paying process portion installed thereon.

In the integral type bill and coin receiving-paying machine, although an occupying area of the machine when installed is approximately the same as that of the cash drawer box 12 as shown in FIG. 28, since the machine has a piling-up structure of the circulation type coin receiving-paying process portion and the circulation type bill receiving-paying process portion, a height of the machine becomes more than two times as high as that of the cash drawer box 12, thus sacrificing a thickness.

In the above circulation type bill receiving-paying process portion, in addition to conventional occupying areas of a circulation type bill receiving portion for a 1000-yen bill, a circulation type bill receiving portion for a 5000-yen bill and a circulation type bill receiving portion for a 10,000-yen bill, a transferring path for distributing the bills to the respective bill receiving portions and a discharging path for discharging the bills from the respective bill receiving portions have to be included, thus resulting in increasing the occupying areas of the respective bill process portions. Also, in order to decrease the thickness of the circulation type bill receiving-paying process portion, since an upright bill is transferred in a longitudinal direction thereof, a width of the transferring path can be reduced in the order of a length of a shorter side of the bill. However, since the bill is transferred in the longitudinal direction thereof, a distance between the respective bill process portions becomes longer, so that the respective bill process portions have to be scattered, thus resulting in increasing the occupying areas. In case the upright bill is transferred in a short side direction thereof, although it is expected to make the occupying area narrow, on the contrary, a height of the machine is increased.

At a time of receiving process in the above circulation type coin receiving-paying process portion, since coins sorted according to denominations are thrown onto a discharging belt of a sorted coin discharging portion so that the coins are stacked in disorder, a sorted coin receiving portion is a disordered coin receiving portion, and a coin receiving efficiency is very low because of spaces created among the coins, so that a space for the sorted coin receiving portion has to be extended to increase a coin accommodating capacity. Also, since the coin accommodating capacity varies according to disorderly stacked coin conditions, the sorted coin receiving portion is an unspecified coin receiving portion, so that a certain room for a coin receiving space has to be kept because of the disorderly received coins.

And, at a time of paying process in the above circulation type coin receiving-paying process portion, the discharging belt is driven by a discharge command for the first time so that the disorderly stacked coins are rearranged in a layer and in a row on the discharging belt, while breaking down the stacked coins one by one by a separating roller (reverse roller), and then the coins in a fallen state are discharged one by one on an outside edge of the belt. Therefore, in order to discharge the lineup coins in the fallen state from various received conditions of the disorderly stacked coins, irregularities are inevitably caused in time for discharging the coins due to an influence of a coin bridge or the like even if the coins of the same denomination are discharged. Thus, when a required number of coins is dispensed, an extra time should be allowed without fail.

Further, since the coins are discharged sequentially after the stacked coins have been rearranged by the separating roller in a layer and in a row, it takes a long time to discharge the coins of different denominations because of their different diameters. Especially, there is an evident difference in time when a 1-yen coin of a small diameter (diameter 26.2 mm) and a 500-yen coin of a large diameter (diameter 34.5 mm) are discharged.

Thus, in view of the above problems, a first object of the present invention is to provide a money receiving-paying machine wherein occupying areas and heights of a circulation type bill receiving-paying process portion and a circulation type coin receiving-paying process portion can be decreased, so that the machine can be miniaturized to approximately the same dimension as that of the cash drawer box.

A second object of the present invention is to provide a money receiving-paying machine wherein coins can be orderly arranged and a fixed number of coins can be stored in the circulation type coin receiving-paying process portion, and at the same time the machine can be made thinner.

SUMMARY OF THE INVENTION

To attain the above-mentioned first and second objects, the present invention is to provide an integral structure wherein a thin and compact circulation type bill receiving-paying process portion and a thin and compact circulation type coin receiving-paying process portion are aligned side by side.

More specifically, the circulation type bill receiving-paying process portion according to the present invention includes a received-bill transferring portion for transferring bills inserted into a bill receiving port provided on a front position; a circulation type bill housing portion for orderly housing the bills by sequentially stacking the transferred bills regardless of their denominations; a leaving-bill separating and discharging portion for separating and discharging the bills one by one from the housing portion; a leaving-bill transferring portion for transferring the discharged bills; a leaving-bill identifying portion for identifying denominations of the bills in the middle of the leaving-bill transferring portion; and a first changeover gate for distributing a bill corresponding to a result of the leaving-bill identifying portion either to a first paying-bill transferring portion for guiding to a first bill paying port provided on a front position or a returning-bill transferring path to be merged with the received-bill transferring portion.

Also, the circulation type coin receiving-paying process portion according to the present invention includes a received coin transferring portion for transferring a plurality of coins simultaneously thrown into a coin receiving port provided at a front position; a coin sorting portion for sorting the transferred coins according to their denominations; rotation type coin receiving cylinders disposed in an inclined or substantially horizontal state for receiving the coins sorted according to denominations in a stacked and upright state; coin discharging portions for discharging the upright coins to the outside one by one from the respective rotation type coin receiving cylinders; and a paying coin transferring portion for transferring coins discharged from the respective coin discharging portions to a coin paying port provided on the front position.

In the circulation type bill receiving-paying process portion is provided only one circulation type bill housing portion for housing bills regardless of their denominations, and in case a bill which is not required for a paying process is discharged from the housing portion, the bill is returned to the received bill transferring portion through the returning-bill transferring path forked from the first changeover gate and again housed in the housing portion, so that housing portions according to the respective denominations are not required to thereby reduce the occupying areas for the housing portions to one third, and at the same time, spaces for received-bill transferring portions for transferring the respective bills according to their denominations and spaces for paying-bill transferring portions from the respective housing portions can be reduced, so that a space for the circulation type bill receiving-paying process portion can be dramatically reduced. On the other hand, in the circulation type coin receiving-paying process portion, since the inclined or substantially horizontal rotation type coin receiving cylinders are employed as a coin housing system, the upright coins can be orderly stacked in a predetermined number, and a height of the device can be extremely reduced. Also, high speed processing for housing and discharging the coins can be attained. Therefore, the money receiving-paying machine can be structured to be approximately the same thin and compact size as that of a cash drawer box.

Here, in case spiral coin feed protruding strips are provided in inner peripheral surfaces of the rotation type coin receiving cylinders according to the denominations of coins, the coins thrown into the coin receiving port in a fallen state can be quickly and positively housed in an uprightly stacked state.

Especially, in case the coin feed protruding strip is formed of a first coin feed protruding strip and a second coin feed protruding strip adjacent thereto with a phase difference less than 180° on a side of the coin receiving port, since the coins transferred in the cylinder are changed from a fallen state to an upright state and stacked so that front surface sides of the coins face a cylinder edge, the coins can be easily changed to the upright state.

The above money receiving-paying machine can employ a structure wherein a plurality of rotation type coin receiving cylinders according to the denominations is disposed horizontally to cross a case and arranged from a front to an inner direction; coin receiving ports of upper side edges of the respective rotation type coin receiving cylinders are positioned on a side of a received-coin transferring portion extending in a front-rear direction; and coin discharging ports of lower side edges of the respective rotation type coin receiving cylinders are positioned on a side of a paying-coin transferring portion extending from a rear-front direction. In this case, it is not necessary to provide the coin sorting portion on a back side, and it is possible to provide the coin sorting portion along the received-coin transferring portion extending from the front to the back direction, so that a space occupied for the circulation type coin receiving-paying process portion can be reduced.

Especially, there can be employed a structure wherein the received-coin transferring portion is positioned on a side of the circulation type bill receiving-paying process portion, and the paying-coin transferring portion is disposed on a side of a side wall of the case. Since the bill receiving port and the coin receiving port can be arranged on right and left sides of a front portion of the device, respectively, operation of the receiving process can be improved.

In case the coin discharging portion is an upright coin discharging portion for discharging the housed coins in an upright state synchronously with rotations of the rotation type coin receiving cylinder, discharge of the coin can be accelerated and at the same time an occupying space for the coin discharging portion can be reduced.

Also, in case the paying-coin transferring portion is a narrow width coin transferring portion for transferring the discharged coins in an upright state, an occupying space for the paying-coin transferring portion can be reduced.

Here, although the narrow width coin transferring portion is formed of a coin transferring belt for constituting a moving path floor and side plates provided on both sides of the belt, in case the coin transferring belt is provided with coin-rotation preventing projections on its surface, since idle running of the upright coins can be prevented, a transferring speed of the coins to the coin paying port can be raised to thereby accelerate the paying process.

Since the circulation type bill receiving-paying process portion of the present invention employs a bill short-side transferring system wherein the bills are transferred in their short-side direction, a bill transferring path becomes short. Further, since a space between the respective bill process portions becomes short, the machine can be miniaturized, and moreover since one circulation time of a bill to be returned to the housing portion through the returning-bill transferring portion can be shortened, even if the circulation type bill housing portion for receiving bills regardless of their denominations is used, a bill processing speed is not decreased.

And, in a structure wherein the leaving-bill separating and discharging portion includes a kick-out roller for discharging bills to an inner direction by contacting back sides of the respective bills stacked in the circulation type bill housing portion, sequentially, and a leaving-bill transferring portion includes a turning-direction changing path for turning downward the bill discharged by the leaving-bill separating and discharging portion at an inner portion and then sending back forward, since the vertically provided double bill-transferring paths are formed, the circulation type bill receiving-paying portion can be made further compact.

Further, in a structure including a second changeover gate for distributing the bill from the first changeover gate in the middle of the returning-bill transferring path to either the second paying-bill transferring portion communicating with the second bill paying port provided in the front position or the returning-bill transferring portion, lower denomination bills (for example, 1,000-yen bill) can be paid to a first bill paying port, and higher denomination bills (for example, 5,000-yen bill) can be paid to a second bill paying port. In case high denomination bills (for example, 10,000-yen bill) which are not suitable as a change are removed from the housing portion to thereby be adjusted, the second bill paying port can also be used.

Especially, in case the second paying-bill transferring portion functions as a paying-bill immediate-before holding portion for holding bills to be discharged to the second bill paying port, the high denomination bills (for example, 5,000-yen bills) can be held in the second paying-bill transferring portion, and the high denomination bills can be paid to the second bill paying port instantly. In the same manner as in a usual paying process, the high denomination bills can be paid faster than the lower denomination bills.

Also, in case the second bill housing portion is provided instead of the second bill paying port, since the high denomination bills (for example, 10,000-yen bills) can be removed from the circulation type bill housing portion and replaced in the second bill housing portion, the bills can hardly be housed excessively in the circulation type bill housing portion, and the number of bill-receiving processes can be increased.

In case the second bill housing portion is a bill housing portion with a key, the high denomination bills can be secured.

Further, in case there is provided a third changeover gate for distributing the bills from the first changeover gate in the middle of the first changeover gate and the second changeover gate of the returning-bill transferring portion to either the third paying-bill transferring portion communicating with the first bill paying port or the returning-bill transferring portion communicating with the merging point, the high denomination bills (for example, 5,000-yen bill) can also be paid to the first bill paying port, so that the lower denomination bill can be placed on the higher denomination bill.

In case the third paying-bill transferring portion is a paying-bill immediate-before holding portion for holding the bills to be discharged to the first bill paying port, since the high denomination bills can be held in the third paying-bill transferring portion, the higher denomination bills can be paid to the first bill paying port faster than the lower denomination bills to thereby accelerate the paying process.

In case a bill receiving port is a bill insertion portion capable of receiving plural bills of different denominations in a gathered state, and there is provided a received-bill separating and discharging portion for separating one by one the bills in the gathered state inserted into the bill insertion portion between the bill insertion portion and the received-bill transferring portion to send out to the received-bill transferring portion, when the plural bills are inserted at the same time, after the bills are separated one by one by the received-bill separating and discharging portion, the bills can be housed in the housing portion through the received-bill transferring portion. Therefore, it is not necessary to insert the bills one by one, so that the receiving process can be accelerated.

Also, in the present invention, in a structure comprising a received-bill identifying portion for identifying denominations of bills separated at the received-bill separating and discharging portion, and a fourth changeover gate for distributing the bills from the received-bill identifying portion in the middle of the received-bill transferring portion to either a rejected-bill transfer portion communicating with a bill-rejecting port or rejecting portion provided at the front position, or the received-bill transferring portion communicating with the merging point, in case a bill which can not be identified is inserted, the received-bill identifying portion detects the bill and returns it to the bill-rejecting port or the rejecting portion through the fourth changeover gate and the rejected-bill transferring portion. Therefore, it is possible to prevent the false bill from being housed in the bill housing portion of the device mixed with other bills to thereby cope with false bills quickly.

And, in a structure including a received bill re-discharge preventing device for closing the discharge path of the bills stacked higher than a reference surface in the circulation type bill housing portion, the reference surface is lowered whenever a bill is discharged from the housing portion, and the bills are re-housed on the reference surface. When the bills under the reference surface are all discharged therefrom, the bill discharging path is closed. More specifically, at any time when all the bills in the housing portion are circulated by one cycle, discharge of the bills is stopped. Therefore, it is possible to sum up the bills housed in the housing portion, so that when an operator changes, an amount of the bills housed in the housing portion and a displayed amount can be collated.

Although the re-discharge preventing device as described above can be formed of a shutter member for closing the bill discharge port by being placed on the bills stacked in the circulation type bill housing portion and descending with discharge of the bills stacked under the shutter member according to discharge operations of the leaving-bill separating and discharging portion, and a shutter member driving device for operating a retreating process of the shutter member, instead of the re-discharge preventing device, a bill-circulation identifying sheet placed on the bills in the circulation type bill housing portion may be used. By summing up the bills from the first discharge of the bill-circulation identifying sheet to the second discharge thereof, the total amount of the bills housed in the housing portion can be calculated. When compared with the case where the re-discharge preventing device is used, the structure can be simplified.

Furthermore, in case there is employed a drawer type structure wherein a money receiving-paying process unit including the circulation type bill receiving-paying process portion, the circulation type coin receiving-paying process portion mounted on a base frame, and at least a bill receiving port, a first bill paying port, a coin receiving port and a coin paying port provided on a front panel, can be inserted into or drawn out of a case in a front-rear direction, when the respective process portions have any problem, the money receiving-paying process unit can be easily drawn out of the case to be exposed, so that the process portion having the problem can be quickly inspected.

BRIEF DESCRIPTION OF THE DRAWINGS

FIG. 11(*a*-1) is a vertical section side view showing a state immediately after a coin is thrown in the rotation type coin receiving cylinder;

FIG. 11(*a*-2) is a vertical section plan view showing the state;

FIG. 11(*a*-3) is a front view showing the state;

FIG. 11(*b*-1) is a vertical section side view showing a state wherein the coin thrown in the rotation type coin receiving cylinder is transferred in an axial direction in a fallen state;

FIG. 11(*b*-2) is a vertical section plan view showing the state thereof;

FIG. 11(*b*-3) is a front view showing the state thereof;

FIG. 11(*c*-1) is a vertical section side view showing a state wherein the coin thrown in the rotation type coin receiving cylinder collides against an edge pressing plate in the fallen state;

FIG. 11(*c*-2) is a vertical section plan view showing the state thereof; and FIG. 11(*c*-3) is a front view showing the state.

FIG. 12(*b*) is a vertical section side view showing a state wherein the coin thrown in the rotation type coin receiving cylinder is stacked on the edge pressing plate while rotating in the upright state; and FIG. 12(*c*) is a vertical section side view showing a state wherein a group of coins thrown in the rotation type coin receiving cylinder are stacked sideways on a side of the edge pressing plate while rotating in the upright state.

FIG. 14(*b*) is a front view thereof.

FIG. 15(*a*-1) is a vertical section side view showing a state immediately after coins are thrown in a rotation type coin receiving cylinder according to the second embodiment;

FIG. 15(*b*-1) is a front view showing the state thereof;

FIG. 15(*a*-2) is a vertical section side view showing a state wherein the coins thrown in a rotation type coin receiving cylinder according to the second embodiment collide against the stacked upright coins in the fallen state;

FIG. 15(*b*-2) is a front view for showing the state thereof;

FIG. 15(*a*-3) is a vertical section side view showing a state immediately after the coins thrown in the rotation type coin receiving cylinder according to the second embodiment collide against the stacked upright coins; and FIG. 15(*b*-3) is a front view showing the state thereof.

FIG. 16(*a*-4) is a vertical section side view showing a state wherein coins thrown in the rotation type coin receiving cylinder according to the second embodiment collide against the stacked upright coins to thereby reverse;

FIG. 16(*b*-4) is a front view showing the state thereof;

FIG. 16(*a*-5) is a vertical section side view showing a state wherein the coins thrown in the rotation type coin receiving cylinder according to the second embodiment are reversed and thereafter brought to an edge;

FIG. 16(*b*-5) is a front view showing the state thereof;

FIG. 16(*a*-6) is a vertical section side view showing a state wherein the coins thrown in the rotation type coin receiving cylinder according to the second embodiment are stacked while rotating in the upright state; and FIG. 16(*b*-6) is a front view showing the state thereof.

DETAILED DESCRIPTION OF THE PREFERRED EMBODIMENTS

Next, embodiments of the present invention are explained with reference to the accompanying drawings.

First Embodiment

Figure 1:
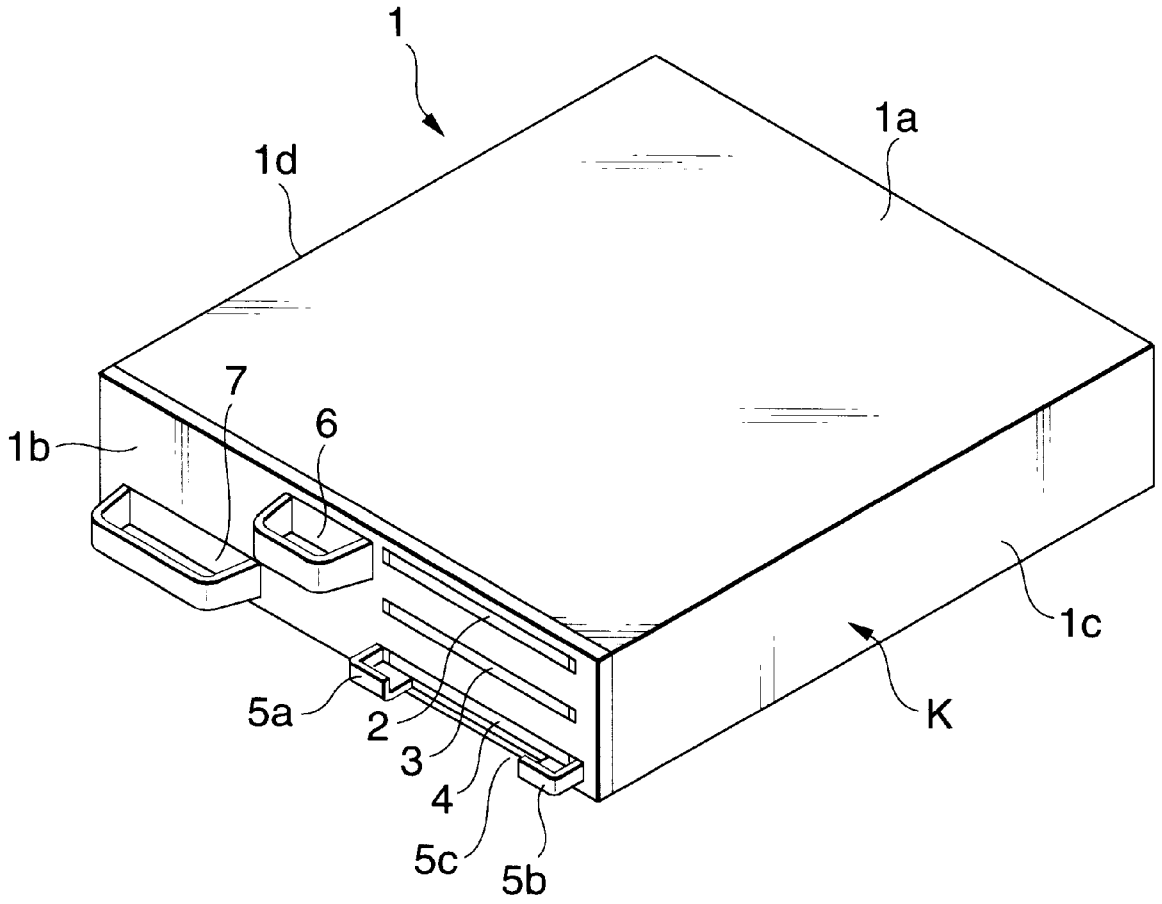
FIG. 1 is a perspective view showing a contour of a money receiving-paying machine of the first embodiment according to the present invention.
Figure 2:
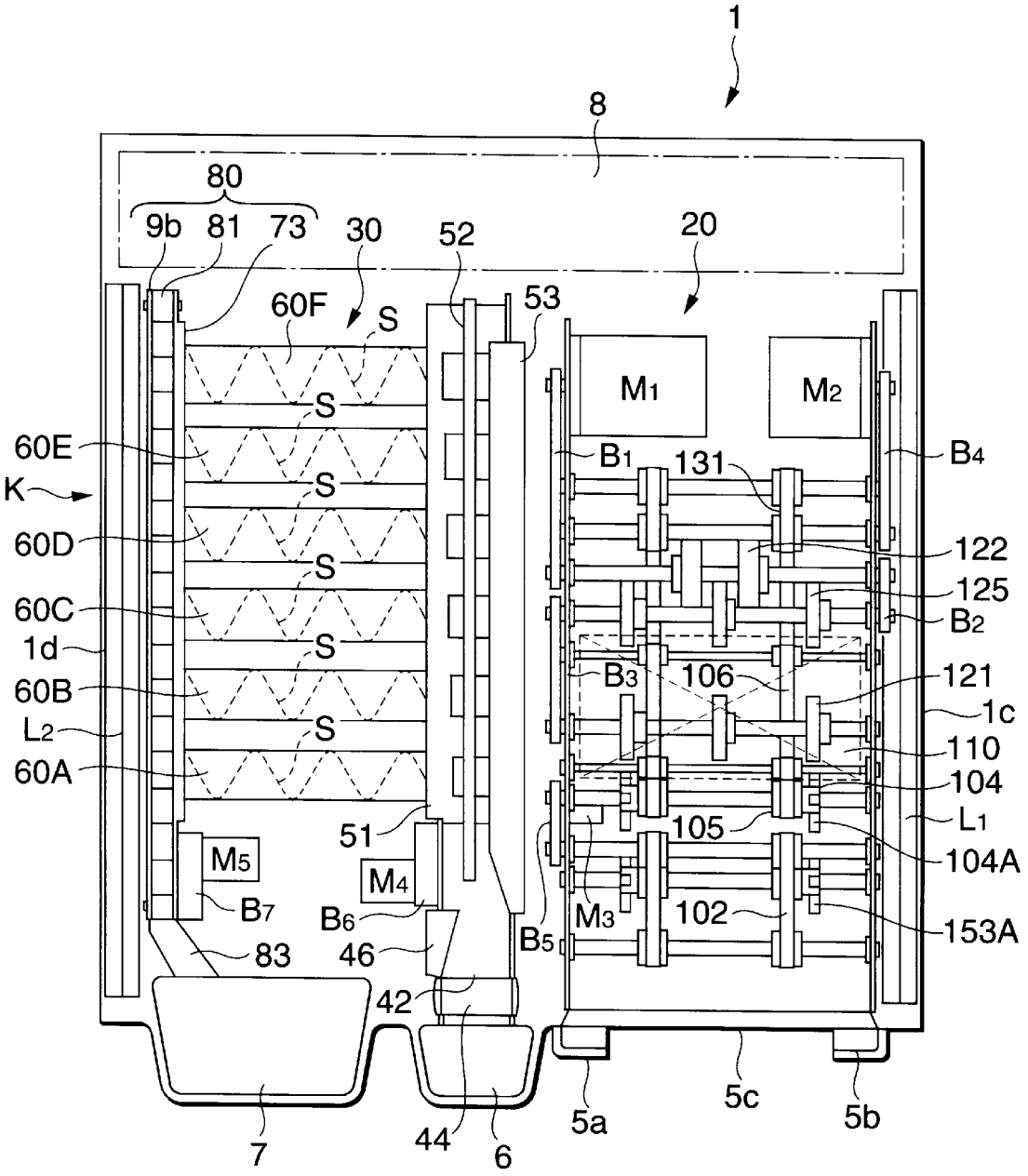
FIG. 2 is a plan view showing the money receiving-paying machine wherein which a cover is removed.
Figure 3:
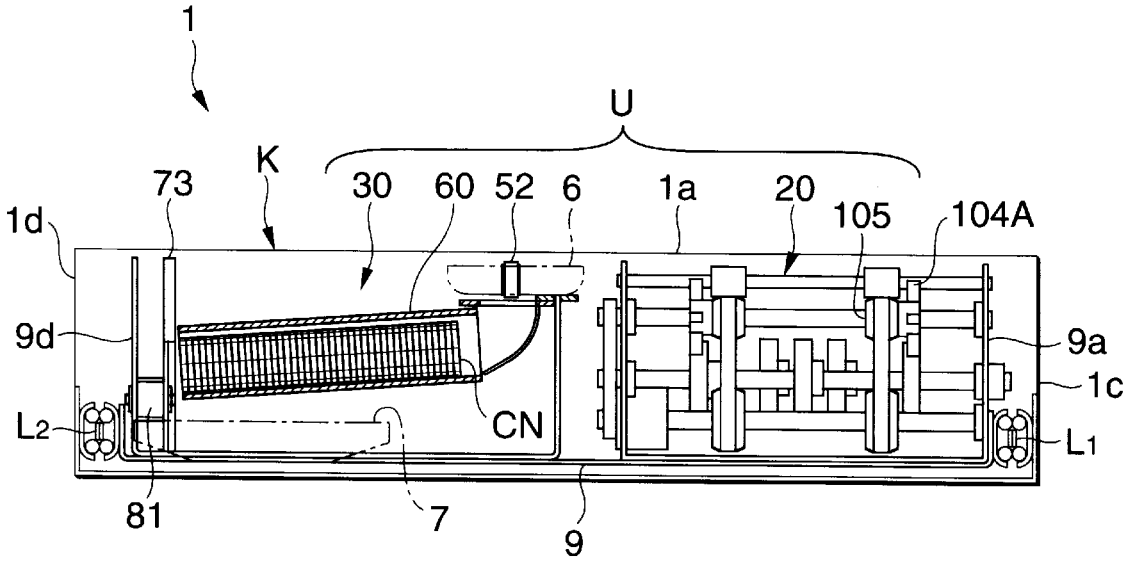
FIG. 3 is a vertical section front view of the money receiving-paying machine.

FIG 1 is a perspective view showing a contour of a money receiving-paying machine of the first embodiment according to the present invention, FIG. 2 is a plan view showing the money receiving-paying machine, case cover of which is removed, and FIG. 3 is a vertical section front view of the money receiving-paying machine.

Figure 13:
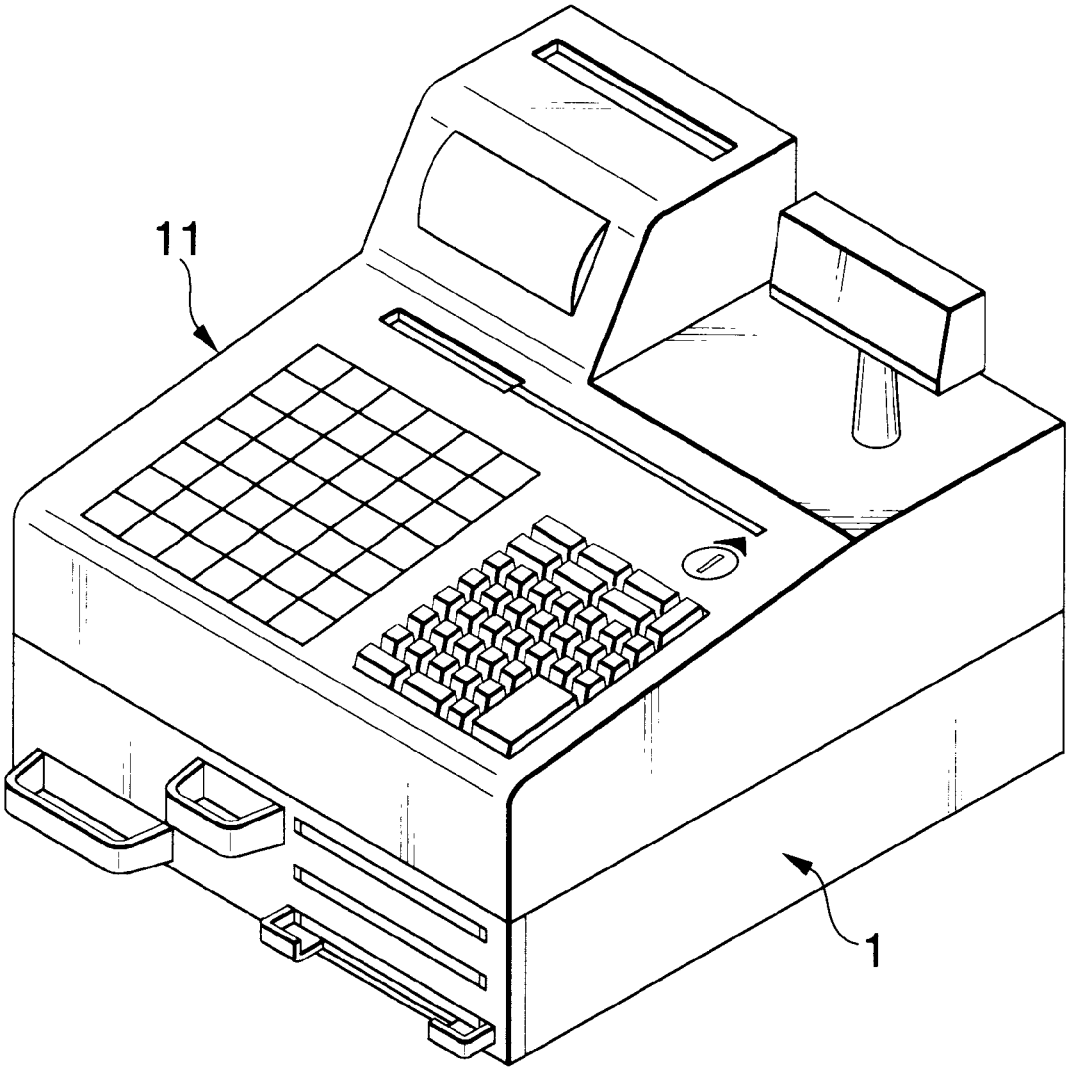
FIG. 13 is a perspective view showing a state wherein a POS terminal is installed on the money receiving-paying machine.

A money receiving-paying machine (automatic change dispenser) 1 of the present embodiment has approximately the same dimension as that of a cash drawer box, and a POS terminal 11 can be installed on a top surface 1*a* of a case cover, as shown in FIG. 13. Although the top surface 1*a* and side surfaces 1*c*, 1*d* of the money receiving-paying machine 1 are flat as in a cash drawer box, in a right half of a front panel 1*b*, there are provided a bill receiving port 2 which is a slit having a length corresponding to a longitudinal side of a bill, a second bill paying port (paying port for a 5,000-yen bill) 3 which is a slit having a length corresponding to a longitudinal side of a bill and provided under the receiving port 2, and a first bill paying port (paying port for a 1,000-yen bill) 4 which is a slit having a length corresponding to a longitudinal side of a bill and provided at the lowermost position. On both sides of the slit as the paying port 4 for the 1,000-yen bill, bill edge receiving portions 5*a*, 5*b* are protruded and a center hollow portion 5*c* is formed therebetween, so that bills discharged from the paying port 4 can be held by a hand. On the other hand, in a left half of the front panel 1*b*, a coin receiving port 6 in a receiving plate shape is disposed on an upper right portion so that coins of plural denominations are thrown thereinto at the same time, and a coin paying port 7 in a receiving plate shape is disposed on a lower left side so that coins of plural denominations are discharged thereon at the same time.

In the money receiving-paying machine 1 of the present embodiment, as shown in FIG. 2, a circulation type bill receiving-paying process portion 20 occupies a right half on the same level, a circulation type coin receiving-paying process portion 30 occupies a left half on the same level, and a controlling portion 8 for mounting a printed circuit plate and the like is provided on a back side thereof.

The circulation type bill receiving-paying process portion 20 and the circulation type coin receiving-paying process portion 30 are mounted on a base frame 9 to constitute a money receiving-paying process unit U. The front panel 1*b* is assembled to the base frame 9. Runner rails $L_1$, $L_2$ are provided, in a front-rear direction, in narrow spaces between both side plates 9*a*, 9*b* of the base frame 9 and a case side surfaces 1*c*, 1*d*, respectively, so that the money receiving-paying process unit U can be drawn out in the front-rear direction with respect to a case K to constitute a drawer. In case there is any problem in the process portion 20 or 30, since the money receiving-paying process unit U can be drawn out to the front side from the case K to be exposed, inspection of the process portions 20, 30 can be quickly carried out.

Figure 4:
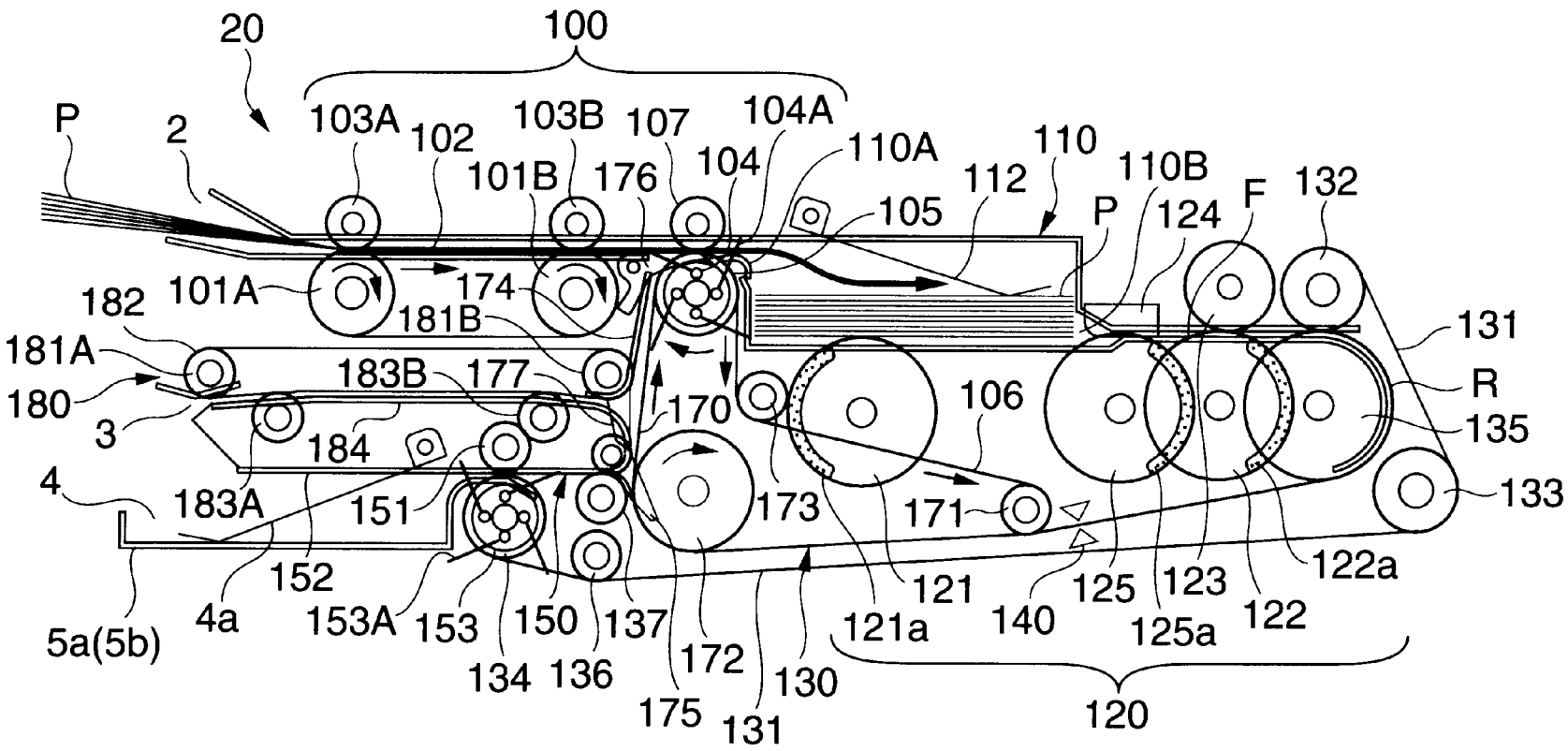
FIG. 4 is a vertical section side view showing a bill receiving operation state of a circulation type bill receiving-paying process portion of the money receiving-paying machine.
Figure 5:
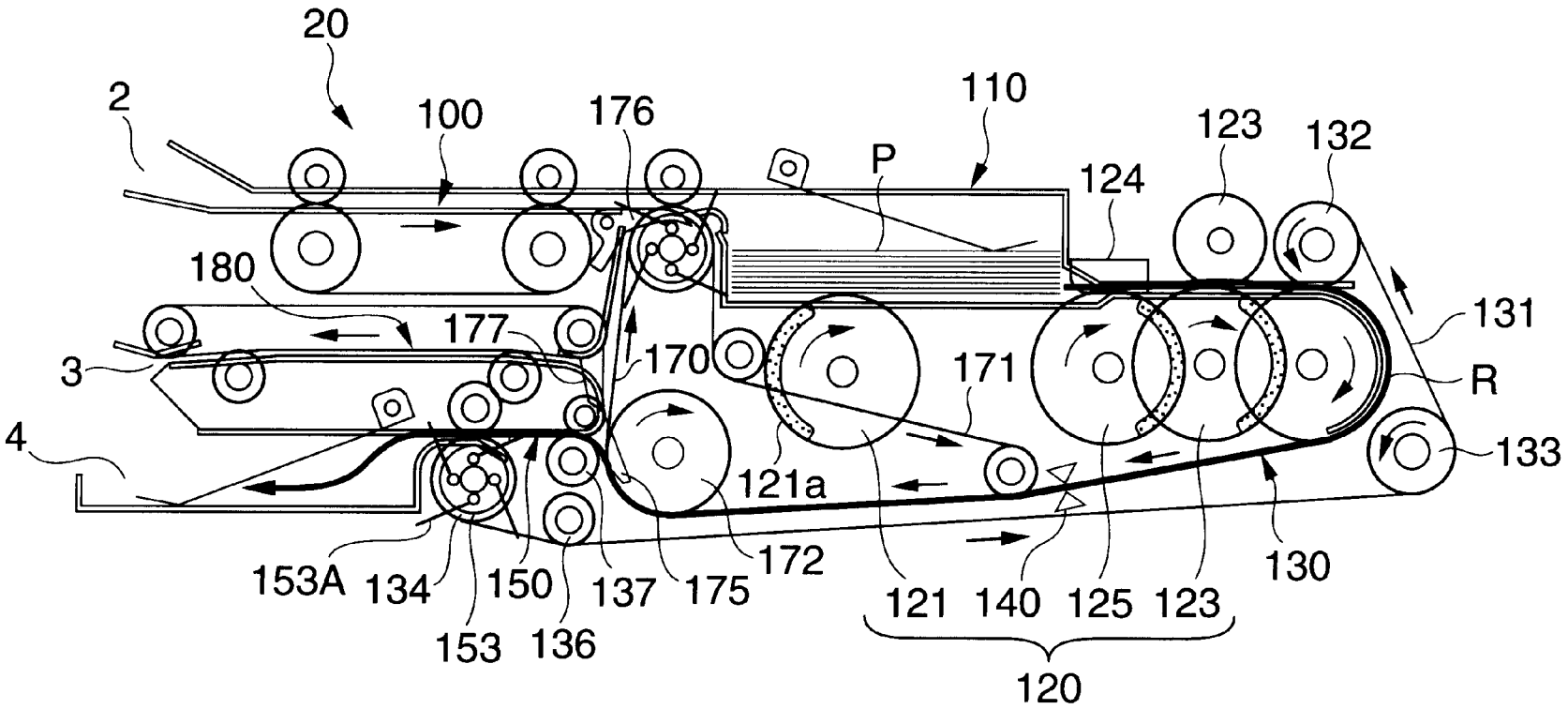
FIG. 5 is a vertical section side view showing a paying operation of a lower denomination bill at the circulation type bill receiving-paying process portion.
Figure 6:
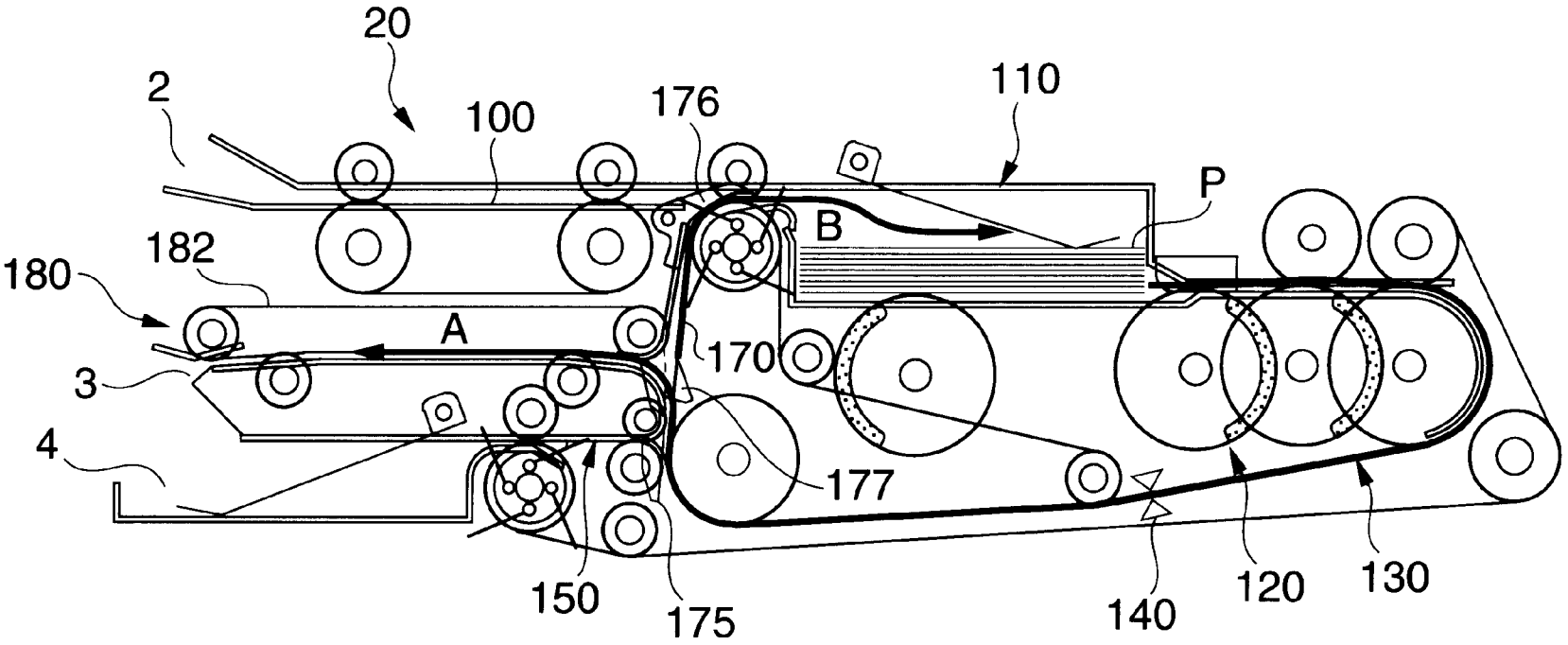
FIG. 6 is a vertical section side view showing a high-denomination bill immediate-before holding state and a bill returning operation at the circulation type bill receiving-paying process portion.
Figure 7:
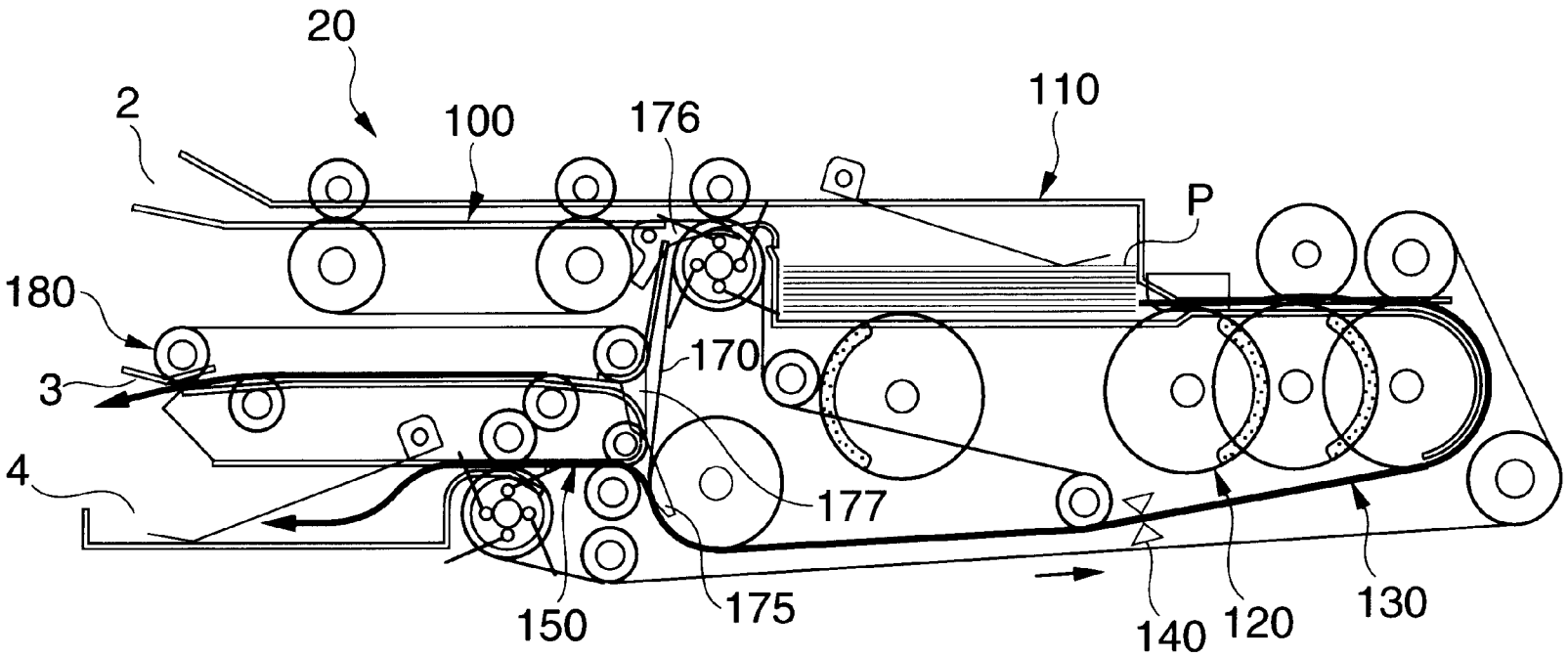
FIG. 7 is a vertical section side view showing paying operations of a lower denomination bill and a higher denomination bill at the circulation type bill receiving-paying process portion.

FIG. 4 is a vertical section side view showing a receiving operation state of the circulation type bill receiving-paying process portion 20 of the money receiving-paying machine, FIG. 5 is a vertical section side view showing a paying operation of a small denomination bill in the circulation type bill receiving-paying process portion 20, FIG. 6 is a vertical section side view showing a right-before holding state and a bill returning operation of a large denomination bill in the circulation type bill receiving-paying process portion 20, and FIG. 7 is a vertical section side view showing paying operations of the small denomination bill and the large denomination bill in the circulation type bill receiving-paying process portion 20.

The circulation type bill receiving-paying process portion 20 of the present embodiment includes a received-bill transferring portion 100 for transferring toward an inner direction (back direction) a bill P inserted in its short-side direction into the bill receiving port 2 provided on the front panel 1*b*; a single circulation type bill housing portion 110 for housing bills orderly irrespective of their denominations by sequentially stacking the received bills; a leaving-bill separating and discharging portion 120 for separating the lowermost bill from the bills stacked in the circulation type bill housing portion 100 one by one and discharging in a back direction; a leaving-bill transferring portion 130 for transferring the discharged bill forward; a leaving-bill identifying portion 140 for identifying a denomination of the transferred bill in the middle of the leaving-bill transferring portion 130; a first changeover gate 175 for distributing the leaving-bill to either a first paying-bill transferring portion 150 for guiding the corresponding bill to the 1,000-yen bill paying port 4 of the front panel 1*b* or a returning-bill transferring portion 170 for allowing the leaving-bill to merge with the received-bill transferring portion 100 according to identification results at the leaving-bill identifying portion 140; and a second changeover gate 177 for distributing the leaving-bill from the first changeover gate 175 to either a second paying-bill transferring portion 180 extending to the 5,000-yen bill paying port 3 of the front panel 1*b* in the middle of the returning-bill transferring portion 170 or the returning-bill transferring portion 170 extending to the above-mentioned merging point.

The received-bill transferring portion 100 is formed of a lower side drawing-in belt 102 extended between pulleys 101A and 101B; upper rollers 103A, 103B pressed against the pulleys 101A, 101B through the belt 102; an impeller 104 having elastic blades 104A for striking down the entering bills into the circulation type bill housing portion 110 in a vicinity of an entrance thereof; a pulley 105 having the same shaft as that of the impeller 104; and an upper roller 107 pressed against a pulley 105 through a return belt 106 which will be described later.

The circulation type bill housing portion 110 is horizontally disposed, and is provided with a housing entrance 110A at a forward upper portion and a housing exit 110B at a backward bottom portion, respectively. Bills transferred in a short side direction thereof are brought in the housing portion as they are in the short side direction, then sequentially stacked therein to be stacked orderly, and discharged in the short side direction thereof through a discharge port 110B at the backward bottom. A leaf spring 112 for giving a weight is provided to press the bills stacked in the bill-housing portion 110 from an upper side thereof.

The leaving-bill separating and discharging portion 120 includes a kick roller 121 for allowing a high friction coefficient material 121*a* provided along a periphery thereof to rush into a bill surface exposure opening formed on a bottom surface of the bill housing portion 110 and frictionally contact with a bottom surface of each of the stacked bills to thereby kick out the lowermost bill in a direction along the bill surface through the discharge port 110B; a lower frictionally press-contact driving roller (feed roller) 122 with a high friction coefficient material 122*a* on a portion of a periphery thereof, provided at a forward portion of a bill discharging path (overlapped bill transfer allowance path) extending from the the discharge port 110B; an upper frictionally press-contact non-rotating roller (friction roller) 123 formed of a sponge or the like to be press-contacted with the roller 122; a pressing member 124 for temporarily making an extra space for allowing a forward edge of the bill appearing to an outside from the discharge port 110B to enter therein, and elastically pressing the bill from an upper side thereof; an intermittently feeding friction roller 125 having a high friction coefficient material 125*a* on a part of a periphery thereof to thereby eccentrically rotate.

The frictionally press-contact non-rotating roller 123 and the frictionally press-contact driving roller 122 constitute a pressure contact type overlapped bill transfer preventing device, and in case plural bills are discharged at the same time through frictional contact of the kick roller 121, since the frictional material is pushed down at an entrance side press contact roll-in area F to thereby have no space for bills to enter therethrough, forward edges of the bills are stopped by abutting thereagainst, but when the high friction coefficient material 122*a* of the frictionally press-contact driving roller 122 frictionally contacts the lowermost bill of the plural bills to slide sideways so that only the lowermost bill is rolled into the press contact roll-in area F to be sent out, the remaining bills are still held in the press contact roll-in area F. Here, the pressing member 124 and the intermittently feeding friction roller 125 constitute a bill inserting supplement device for forcibly inserting the bill into the press contact roll-in area F by holding the forward edge of the kicked-out bill. Incidentally, as shown in FIG. 2, the kick roller 121, intermittently feeding friction roller 125 and frictionally press-contact driving roller 122 have a motor $M_1$ as a driving source, and are synchronously rotated through timing belts $B_1$ through $B_3$.

The leaving-bill transferring portion 130 is mainly formed of a discharging-transferring belt 131, and has a turning-direction changing path R for turning downward the bill transferred to an inner portion from the housing portion 110 and returning the bill forward. The discharging-transferring belt 131 is turned around a driving pulley 132 for defining an upper edge provided in a vicinity of the frictionally press-contact non-rotating roller 123; a guide pulley 133 for defining a rear position; a driven pulley 134 for defining a front position; a tension pulley 135 for defining the turning-direction changing path R; and guide pulleys 136, 137 provided rear of the driven pulley 134 for expanding a stretching side and a loosening side outward. To the discharging-transferring belt 131 is applied a downward tension by a guide pulley 171 for defining a rear position and a driving pulley 172 for defining a lower forward edge around which a return belt 106 for constituting the returning-bill transferring portion 170 is turned, so that the bill is held between the upper return belt 106 and the lower discharging-transferring belt 131 to be transferred forward. Incidentally, the driving pulley 132 is rotated by the motor $M_2$ through the timing belt $B_4$.

The first changeover gate 175 is provided at a diverging point where the overlapped discharging-transferring belt 131 and return belt 106 are separated. The first paying-bill transferring portion 150 for guiding to the 1,000-yen bill paying port 4 in the receiving plate shape includes a belt segment extending from the first changeover gate 175 to the driven pulley 134 along the discharging-transferring belt 131; the pressure contacting roller 151 for pressing the driven pulley 134 through the belt from an upper side; a cover guide plate 152 projecting over the 1,000-yen bill paying port 4 in the receiving plate shape; and an impeller 153 having elastic vanes 153A for striking down the bill into the 1,000-yen bill paying port 4 having the same shaft as that of the driven pulley 134. A bend of the belt segment from the driving pulley 172 of the discharging-transferring belt 131 to the driven pulley 134 is curved in a direction opposite to that of the turning-direction changing path R. Also, the 1,000-yen bill paying port 4 is provided with a leaf spring 4*a* for pressing, from an upper side, the bills discharged to the 1,000-yen bill paying port 4.

The returning-bill transferring portion 170 is an ascending belt segment from the driving pulley 172 to the upper end defining pulley 105 of the return belt 106 wound around the driving pulley 172, the upper end defining pulley 105, the rear position defining pulley 171 and a tension pulley 173 disposed at an intermediate position between the pulleys 105, 171, and along the transferring portion 170, a covering guide plate 174 is provided. At a merging point of the returning-bill transferring portion 170 and the received-bill transferring portion 100 is provided a merging point changeover gate 176 for selectively guiding a bill from either the transferring portion 170 or the transferring portion 100 to the received-bill transferring portion on the pulley 105. Incidentally, the returning-bill transferring portion 170 may be directly connected with a receiving port 110A of the housing portion 110, not merged into the received-bill transferring portion 100.

Between the first changeover gate 175 of the returning-bill transfer portion 170 and the merging point changeover gate 176 is provided a second changeover gate 177. And, a second paying-bill transferring portion 180 includes an upper draw-in belt 182 extended between the pulleys 181A and 181B; lower rollers 183A, 183B for pressure-contacting the draw-in belt 182; and the receiving guide plate 184. Incidentally, the driving pulley 172 and pulleys 181B and 103B are driven by the motor $M_3$ as a driving source, and are synchronously rotated by the timing belt $B_5$.

At a time of bill-receiving process, when bills P are inserted into the bill receiving port 2 in a bill short-side direction, the motor $M_3$ is activated, the bills P are transferred to an inner portion by a drawing-in belt 102 through driving of the drawing-in belt 102 and the return belt 106, as shown by an arrow in FIG. 4, and are stacked in the housing portion 110 to thereby complete the bill-receiving process. The bills of different denominations are orderly stacked in only the single housing portion 110. Since the received-bill transferring portion 100 functions as a transferring path in the bill short-side direction, a length of the path to the housing portion 110 can be shortened.

At a time of paying process of the 1,000-yen bill, the motors $M_1$ to $M_3$ are activated, and the bills are discharged one by one to the inner portion from a bottom surface of the housing portion 110 through the leaving-bill separating portion 120. Each bill discharged to the inner portion is reversed at the turning-direction changing path R with a curved shape by being held between the discharging-transferring belt 131 and the tension pulley 135 to thereby be transferred forward. Then, in case the leaving bill is identified as a 1,000-yen bill at the leaving-bill identifying portion 140, the first changeover gate 175 is held in a state as shown in FIG. 5, and the bill is discharged to the 1,000-yen bill paying port 4 through the first paying-bill transferring portion 150. Here, although the bill P left from the housing portion 110 is deeply bent in the bill short-side direction at the turning-direction changing path R, the bill is deeply bent in the reverse direction thereof at a path formed of the pulleys 172 and 137 of the first paying-bill transferring portion 150 to thereby correct the first bent.

At the time of bill-paying process, in case a high denomination bill (5,000-yen bill or 10,000-yen bill) is discharged from the housing portion, the denomination of the bill is identified at the leaving-bill identifying portion 140. When the bill is a 5,000-yen bill and required as a change, as shown in FIG. 6, the first changeover gate 175 is changed over, the 5,000-yen bill enters the returning-bill transferring portion 170 and is held in the second paying-bill transferring portion 180 through the second changeover gate 177, as shown by an arrow A. Since the second paying-bill transferring portion 180 has a belt length longer than a bill short-side length, the second paying-bill transferring portion is used as an immediate-before holding portion for holding the 5,000-yen bill, so that it is possible to discharge the 5,000-yen bill to the paying bill port 3 in a short time at the time of change bill payment. After the 5,000-yen bill is paid through the second paying-bill transferring portion 180, another 5,000-yen bill is supplied to the second paying-bill transferring portion 180 from the housing portion 110.

On the other hand, in case a 10,000-yen bill is discharged from the housing portion 110, since the 10,000-yen bill can not be a change bill, as shown by an arrow B in FIG. 6, the 10,000-yen bill enters the received-bill transferring portion 100 through the returning-bill transferring path 170 to be returned to the housing portion 110. Further, in case a bill discharged from the housing portion 110, which is a 1,000-yen bill or 5,000-yen bill, is not wanted as a change bill, the bill is returned to the housing portion 110 through a path shown by an arrow B.

In FIG. 7, a 5,000-yen bill held at the second paying-bill transferring portion 180 is discharged to the 5,000-yen bill paying port 3, and at the same time, a 1,000-yen bill sent out from the housing portion 110 is discharged to the 1,000-yen bill paying port 4.

As described hereinabove, the circulation type bill receiving-paying process portion 20 of the present embodiment includes only the single circulation type bill housing portion 110 where bills of different denominations are stacked to thereby reduce the occupying area to one third, and installation areas of a received-bill transferring portion for distributing and transferring the received-bills according to denominations of the bills and a paying-bill transferring portion from plural housing portions have been reduced. Also, since a system for transferring bills in the bill short-side direction is employed and the turning-direction changing path R provided at an inner portion is provided, a space for the circulation type bill receiving-paying process portion 20 can be dramatically reduced.

Incidentally, in case there is enough space, although an upright bill can be transferred in its longitudinal direction, the received-bill transferring portion 100, housing portion 110, leaving-bill separating and discharging portion 120 and leaving-bill transferring portion 130 become longer, so that the device in the front-rear direction becomes longer. In case a transferring system where a fallen (horizontal) bill is transferred in its short-side direction is employed, the bill discharged from the housing portion 110 may be turned upward and transferred forward. However, this system is a transferring system against a potential of the bill itself, and also a bending nature of the bill is hardly restored until the bill reaches the bill paying port, which results in disadvantages.

Figure 8:
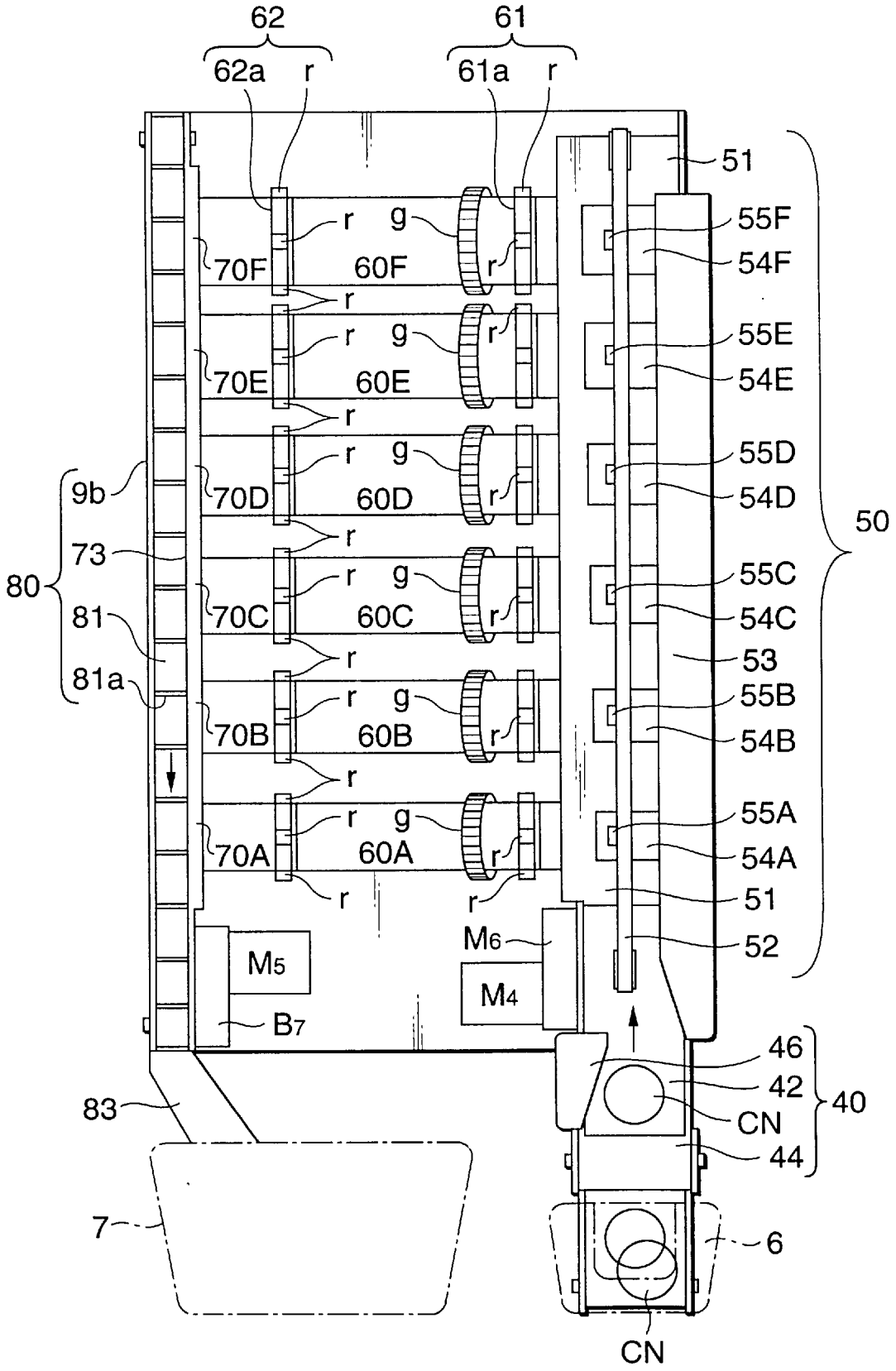
FIG. 8 is a plan view showing a circulation type coin receiving-paying process portion of the money receiving-paying machine.
Figure 9:
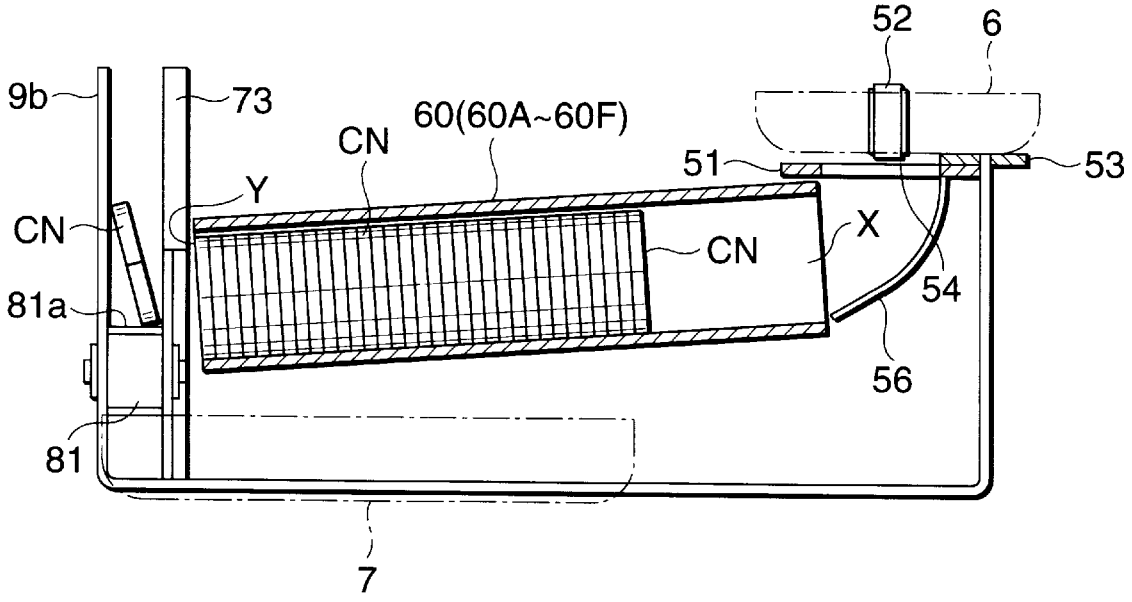
FIG. 9 is a vertical section plan view showing the circulation type coin receiving-paying process portion.
Figure 10:
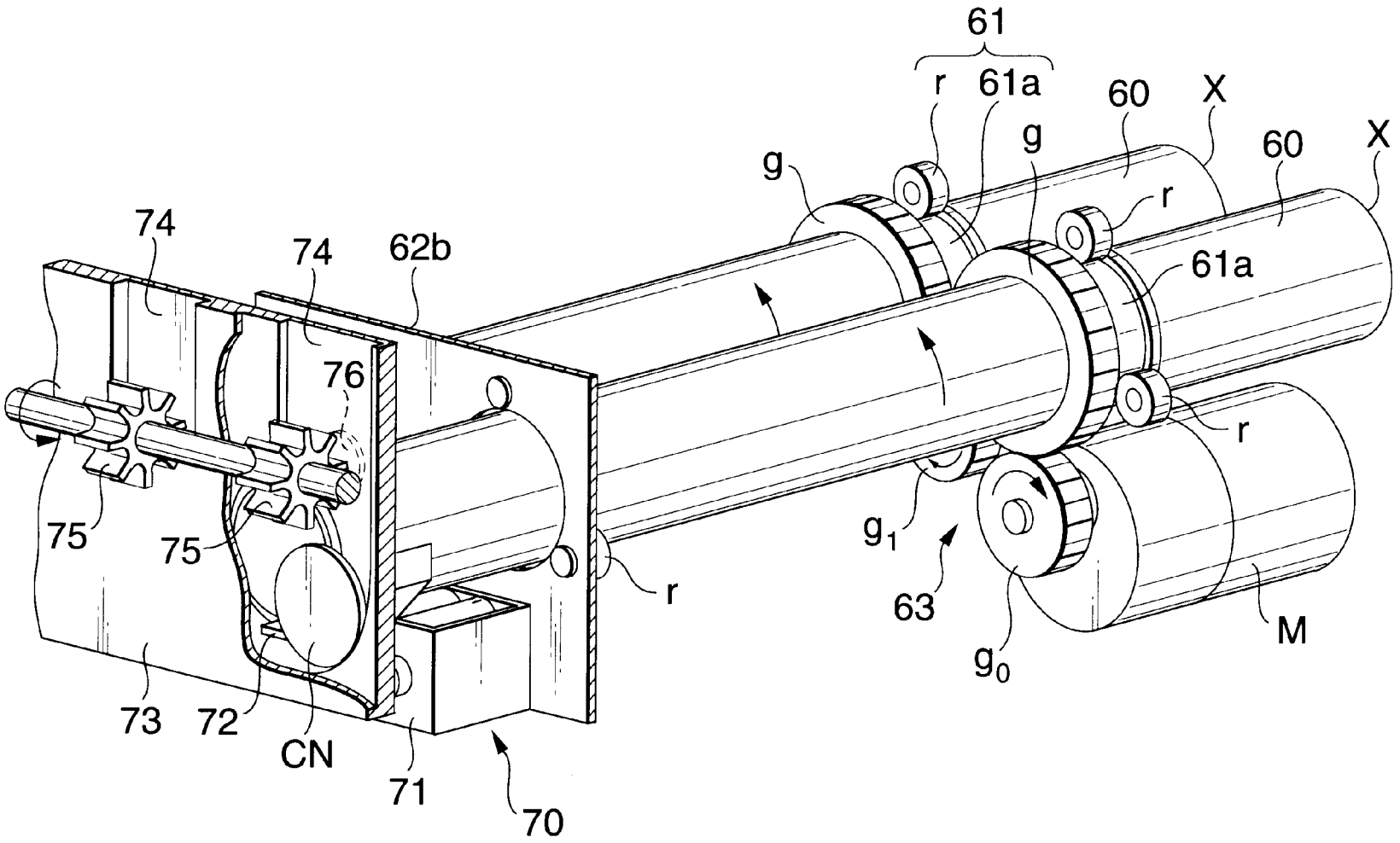
FIG. 10 is a partially cut perspective view showing rotation type coin receiving cylinders and coin discharging portion thereof at the circulation type coin receiving-paying process portion.

FIG. 8 is a plan view showing a circulation type coin receiving-paying process portion 30, FIG. 9 is a vertical section front view of the circulation type coin receiving-paying process portion, and FIG. 10 is a partially cut perspective view showing a rotation type coin receiving cylinder and a coin discharging portion of the circulation type coin receiving-paying process portion, of the present embodiment, respectively.

The circulation type coin receiving-paying process portion 30 is formed of a coin separating and sending-out portion 40 for separating a plurality of coins, one by one, received in the coin receiving port 6 provided on the front panel 1*b* and sending rearward; a rearwardly extending coin sorting portion 50 for sorting the coins based on respective denominations while transferring the discharged coins rearward (in a backside direction); inclined or substantially horizontal rotation type coin receiving cylinders 60 (60A–60F) for stacking the sorted coins in an upright state based on each denomination to receive therein; coin discharging portions 70 (70A–70F) for discharging the upright coins from the rotation type coin receiving cylinders 60 one by one to outsides thereof; and a forwardly extending paying-coin transfer portion 80 for transferring the coins discharged at the respective coin discharging portions 70 to the coin paying port 7 of the front panel 1*b*.

The coin separating and sending-out portion 40 includes a received coin transfer wide belt 42 constituting a bottom surface of the coin receiving port 6 and extending in a back direction of the device with an upward inclination; a reverse roller 44 provided in the middle of the transfer belt 42 in a belt crossing direction, and for breaking down the coins stacked on the belt and arranging the coins side by side in a layer in a fallen state; and a width adjustment guide 46 provided at a rear side edge of the reverse roller.

The coin sorting portion 50 is formed of a coin sliding surface path 51 extending from an edge of the received coin transfer belt 42 to a back side of the device; a coin holding-down and transferring round belt 52 for slidingly transferring coins in the back direction while holding down the coins on the path 51 from an upper side; a reference rail 53 for guiding the coin with a width adjustment at a side edge thereof; a 1-yen coin sorting port 54A, a 50-yen coin sorting port 54B, a 5-yen coin sorting port 54C, a 100-yen coin sorting port 54D, a 10-yen coin sorting port 54E and a 500-yen coin sorting port 54F, all of which are disposed in this order from a front portion of the coin sliding surface path 51 to the back direction thereof; cone rollers 55A–55F for pressing the coins CN slidingly transferred into coin sorting ports 54A–54F from an upper portion of the extended belt 52; and coin throw-in chutes 56 for guiding the sorted coins dropped from the coin sorting ports 54A–54F (54) to coin receiving ports X at one end of the rotation type coin receiving cylinders 60 (60A–60F). Incidentally, the received coin transfer belt 42, reverse roller 44 and coin holding-down and transferring round belt 52 are driven by the motor $M_4$ as a driving source, and are synchronously rotated through the timing belt $B_6$.

The plural rotation type coin receiving cylinders 60A–60F according to different denominations are positioned in the transverse direction of the device and arranged side by side from the front side to the inner direction for 1-yen coin, 50-yen coin, 5-yen coin, 100-yen coin, 10-yen coin and 500-yen coin in this order. The coin receiving ports X at upper side edges of the respective rotation type coin receiving cylinders 60 with an about 5° inclination face the coin throw-in chutes 56 of the coin sorting portion 50, and the coin discharging ports Y at lower side edges thereof face the paying-coin transfer portion 80. Upper sides and lower sides of the respective rotation type coin receiving cylinders 60 are provided with roller supporting mechanisms (roller bearings) 61, 62, respectively, to support in contact with the outer peripheral surfaces thereof, and near the upper side roller supporting mechanism 61 is provided a rotary driving mechanism 63. The upper side roller supporting mechanism 61 is formed of three idle rollers r with three equal intervals therebetween and rotated on a rotary orbit surface 61*a* with a flange on an outer peripheral surface of the coin receiving cylinder 60, and these rollers r are rotatably supported by a bracket, not shown. Also, the lower side roller supporting mechanism 62 is formed of a rotary orbit surface 62*a* with a flange on the outer peripheral surface and three idle rollers r, as in the upper side roller supporting mechanism 61, and the idle rollers r are supported by a bracket 62*b*.

The rotary driving mechanism 63 includes a single driving motor M installed in a space between a case bottom surface and the coin receiving port X side of the inclined coin receiving cylinder 60; an output spur gear $g_o$; flange-shape spur gears g fitted near the rotating orbit surfaces 61*a* on the upper side of the respective coin receiving cylinders 60; and a parameter spur gear $g_1$ for rotatably transmitting between the adjacent flange-shape spur gears g, g. The output spur gear $g_o$ is engaged with the flange-shape spur gear g on one side of the coin receiving cylinder 60 and transmits a rotary force to flange-shape spur gears g of the other coin receiving cylinders 60 in a cascade state through the parameter spur gears $g_1$. Therefore, in case the six coin receiving cylinders 60 are rotated, the single motor M can drive them to thereby simplify and miniaturize the driving system.

Each rotation type coin receiving cylinder 60 of the present embodiment is provided with a coin feed protruding strip S, having a rectangular section, along an inner spiral peripheral surface thereof. Although the coin feed protruding strip S may not be provided on the inner peripheral surface of the inclined rotation type coin receiving cylinder 60, in case the protruding strip S is not provided, when the fallen-state coins CN thrown into the coin receiving port X are set upright to be stacked, the uprightly setting action becomes slightly uncertain. More specifically, in case the rotation type coin receiving cylinder 60 does not have the coin feed protruding strip S, rotation moment is given to peripheral edges of the fallen coins through contact friction between the coins and the inner peripheral surface of the rotation type coin receiving cylinder to thereby make the coins upright by themselves, and then self-sideslip of the upright coins is made to thereby be stacked in the upright state. Therefore, in case the contact friction in the self standing-up movement of the coins is too small or the coins are thrown in too forcibly so that the contact friction becomes intermittent, since it is difficult that the fallen coins stand up by themselves, the fallen coins are liable to slip down as they are along the inner peripheral surface. On the other hand, in case the contact friction is too large, the coins thrown thereinto stick to a ceiling side of the inner peripheral surface in the fallen state in the vicinity of the coin throw-in portion to stay there while rotating, and do not self-stand at all. Therefore, in the self-standing-up process, the magnitude of the friction force has to be delicately set. Further, in the sideslip process after the coins stand up, when the friction force is small, the coins are easily sideslipped. When the inclined angle of the rotation type coin receiving cylinder becomes large, the sideslipping of the coins in self-standing-up state becomes difficult. Also, in case the friction is large, it is substantially impossible to lay the rotating cylinders in a horizontal state. Since the contact friction between the inner peripheral surface of the receiving cylinder and the coin plays a great part in the respective processes, although it is most important to optimize the contact friction, here, also, selection of materials and maintenance of abrasion resistance, coarse degree of the inner peripheral surface of the cylinder or the friction force when foreign matters, such as water and dust, are mixed in, become obstacles to be put to practical use. Thus, the standing-up process and self standing-up sideslip process of the fallen coins can not be secured due to the various uncertainties as mentioned above.

Therefore, in the rotation type coin receiving cylinders 60 of the present embodiment, in view of the uncertainties of the self-standing-up/self-running of the coins as described above, the spiral-shape coin feed protruding strip S for positively and forcibly changing the fallen coins at a predetermined position to upright and forward-facing coins is provided in the inner peripheral surface.

The coin discharging portion 70 (70A–70F) includes a coin discharge activating solenoid 71; a coin splashing pawl 72 for frequently appearing in the cylinder inner periphery of the lower side edge of the rotation type coin receiving cylinder 60 by a plunger of the solenoid; and a coin splashing rubber impeller 75 for assisting an upper feed of the coin CN splashed to an upper part of the coin splashing pawl 72 in a coin splashing path 74 of an edge pressing plate 73 as a coin hitting-receiving device. A coin CN can be easily splashed to the upper part, whenever the receiving cylinder 60 is rotated, through the frequent appearances of the coin splashing pawl 72. Incidentally, a counting sensor 76 for detecting passage of the discharged coin CN is provided in the coin splashing path 74.

The paying-coin transfer portion 80 is a coin transfer narrow width portion for transferring upright coins discharged from the respective coin discharging portions 70 (70A–70F), and includes a coin transfer narrow belt (toothed belt) 81 for constituting a transfer floor surface, and a side plate 9*b* and an edge pressing plate 73 disposed on both sides of the belt 81. Since a width of the coin transfer narrow belt 81 is shorter than a diameter of the 1-yen coin which is the shortest, the discharged upright coins are held in an upright state by leaning on either plate 9*b* or plate 73. In the present embodiment, in order to collect or gather the coins to the coin paying port 7 at a high speed, although the transfer belt 81 is used as a path floor, in case the high speed transfer is not required, a tapered conduit may be used. However, since the path floor of the coin path is transferred by the transfer belt 81, there is a risk of the upright coins being inversed. Therefore, the transfer belt 81 of the present embodiment has coin-inversion preventing projections 81*a* with a predetermined pitch therebetween on the surface of the belt 81. Incidentally, the transfer belt 81 has the motor $M_5$ as a driving source and is driven through the timing belt $B_7$. A coin guiding path 83 connecting a forward end of the transfer belt 81 to the coin paying port 7 is provided.

In the coin receiving process, a plurality of coins having different denominations is thrown into the coin receiving port 6 at the same time. The thrown-in coins CN are sent out one by one toward the back side by the received-coin transfer belt 42 and the reverse roller 44, and their passing loci are corrected by the width adjustment guide 46. Then, the coins are slid to be transferred on the coin sliding surface path 51 along the reference rail 53 by the coin holding down-transfer belt 52, and when the coins reach respective corresponding coin sorting ports 54A–54F, the coins are dropped into the corresponding coin sorting ports 54A–54F by pushing forces of the corresponding cone rollers 55A–55F. The sorted coins CN are thrown into the coin receiving ports X of the rotation type coin receiving cylinders 60 through the coin throw-in chutes 56.

As shown in FIG. 11(*a*-1)–FIG. 11(*a*-3), when the coin CN is thrown into the coin receiving port X of the inclined state coin receiving cylinder 60 through the coin throw-in chute 56, the coin CN is placed, in a fallen-state, on a hollow section (seat portion) T sandwiched between the adjacent coin feed protruding strip portions S, S at a bottom side of the cylinder inner peripheral surface in the vicinity of the coin receiving port X. In this state, although the coin is supported at left and right points p and p, with respect to an axial direction of the cylinder, of a peripheral edge of the fallen coin CN in contact with a surface of the hollow section T between the protruding strip portion, since the coin receiving cylinder 60 is rotated in an arrow direction in such a supporting state at the left and right edges of the fallen coin CN, two rear points or one point Q of the peripheral edge of the coin contact the rotating coin feed protruding strip S to receive pushing-out forces F in a normal direction and to be guided along a bottom side by a component of the force in the axial direction.

In the process for feeding the fallen coin CN in the axial direction by the coin feed protruding strip portions, since the component of the force in the rotation direction is also applied thereto, even if the inner peripheral surface of the coin receiving cylinder 60 is smooth, as shown in FIG. 11(*b*-1) to FIG. 11(*b*-3), the fallen coin CN is slightly lifted about one shoulder in its rotating direction. In case the inner peripheral surface of the coin receiving cylinder 60 is coarse, the lifting degree in one shoulder of the fallen coin CN becomes large by its friction force. The fallen coin CN slidingly fed in the axial direction in such an inclined state collides against the edge pressing plate 73 provided at the lower side edge Y of the coin receiving cylinder 60.

Figure 12A:
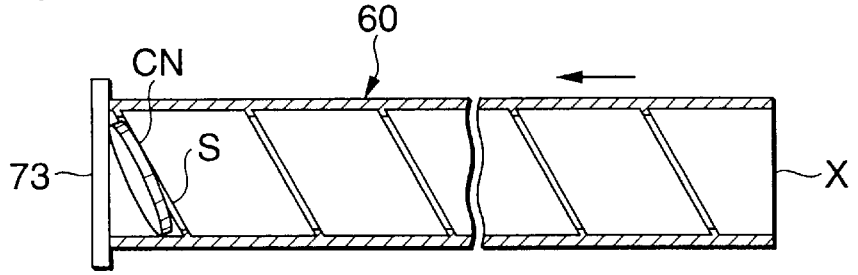
FIG. 12(*a*) is a vertical section side view showing a state immediately after the coin thrown in the rotation type coin receiving cylinder collides against the edge pressing plate.
Figure 12B:
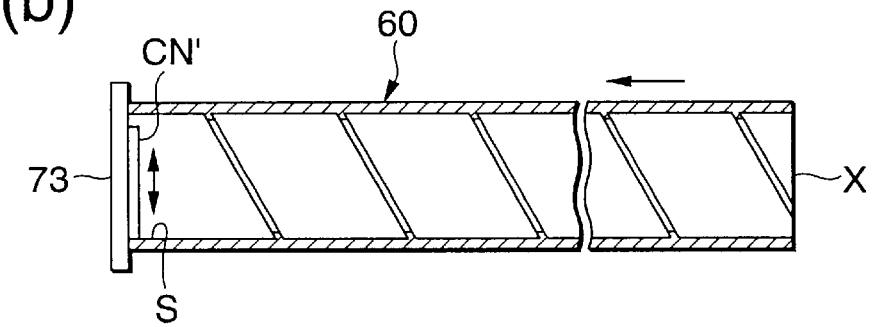
Figure 12C:
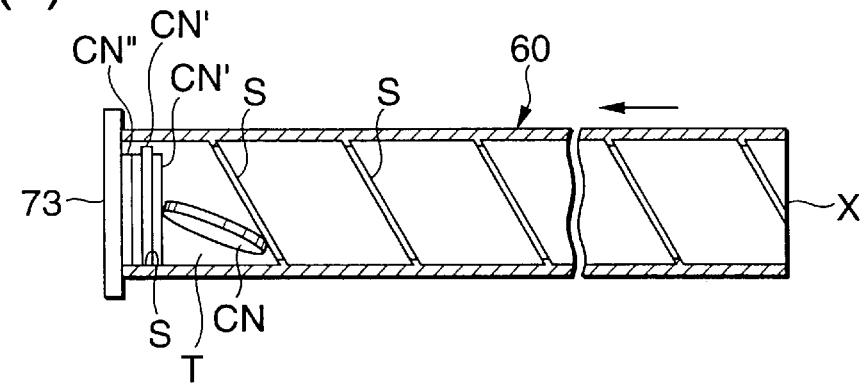

As shown in FIG. 11(*c*-1)–FIG. 11(*c*-3), when collided, although the fallen coin CN abuts against the edge pressing plate 73 at its peripheral front portion, since the fallen coin CN is slightly lifted about one shoulder thereof in its rotating direction immediately before the collision and the rear part of the peripheral edge of the coin runs on the coin feed protruding strip S, when collided, the coin feed protruding strip S slides into a front portion of the back surface of the collided coin, so that the collided coin takes a front lifted posture and at the same time is given a component of force in the rotating direction by the coin feed protruding strip S, and the rear part (lower part) of the coin peripheral edge is received by the adjacent coin feed protruding strip S provided in a rear side thereof. Therefore, the collided coin CN is relatively rolled back by the edge pressing plate 73, and as shown in FIG. 12(*a*), since the rear part of the coin peripheral edge is allowed to approach the edge pressing plate by the coin feed protruding strip S, the fallen coin CN is forcibly changed to an upright state at the edge pressing plate 73, as shown by FIG. 12(*b*).

Simultaneously with becoming the upright state, in contact with the bottom side of the coin receiving cylinder 60, the upright coin CN' is synchronously rotated with the coin receiving cylinder 60, so that even in case of a horizontal-state coin receiving cylinder 60, the upright coin CN' hardly falls down to the hollow side of the coin receiving cylinder 60 by its acquired rotation inertia. In a state where the upright coin CN' leans on the edge pressing plate 73, still more it does not fall down. Here, since the rotating upright coin CN' runs on the coin feed protruding strip S whenever the coin receiving cylinder 60 is rotated, although the rotating coin is subjected to vertical vibrations in a direction along its surface, the coin does not fall down due to the rotation inertia though it slightly wobbles.

As described hereinabove, after the first coin stands up against the edge pressing plate 73 of the coin receiving cylinder 60, the first coin functions as a coin hitting-receiving device for the next fallen coin CN, and the fallen coin CN lying in the hollow section T between the protruding strips collides against the upright coin CN' to stand up and rotate. Therefore, as shown in FIG. 12(*c*), plural fallen coins CN thrown into the coin receiving port X of the coin receiving cylinder 60 are stacked sideways to be housed on a side of the edge pressing plate 73, while rotating in the upright state.

In the present embodiment, a friction coefficient between an inner peripheral surface of the rotation type coin receiving cylinder 60 and the coin CN does not become a delicate factor for the coin to stand up and rotate. Since the coin slides in the rotation type coin receiving cylinder 60 in an axial direction thereof, in order to reduce abrasion, it is preferable that the friction coefficient be small. However, as shown in FIGS. 11(*a*-1)–FIG. 11(*a*-3), since the coin slides with point contacts, instead of a surface contact, supported at left and right edges P, P thereof, the abrasion problem is not so serious. Even with a lower friction coefficient, the sliding fallen coin CN takes a one-shoulder lifted posture to a certain extent. When a rotating speed of the rotation type coin receiving cylinder 60 is increased, a transfer speed of the fallen coin CN is increased and the one-shoulder lifted posture of the fallen coin CN becomes strong. Therefore, a process time for stacking the thrown-in coins can be shortened. However, in case the rotation type coin receiving cylinder 60 is rotated at an excessively high speed, since the thrown-in coins self-stand or stick to the inner peripheral surface in the fallen-state to stay there, it is required to prevent the coin receiving cylinder from being rotated at the excessively high speed. Conversely, in case the coin receiving cylinder is rotated at a very low speed less than 1 rps, since the collision speed and an edge adjustment action in the standing-up process of the coin become slow, the coin may not stand up thus to prevent the rotation at the excessively low speed.

Here, although the length of the rotation type coin receiving cylinder 60 is required to be longer than a pitch P between the coin feed protruding strips S, for example, in case the cylinder is a short cylinder formed of two to three pitches P, a thrown-in coin may directly and forcibly collide against the edge pressing plate 73 or housed coin CN' in the upright state, not to be housed in the hollow section T between the protruding strips in the vicinity of the coin receiving port X. This situation is likely to occur in case the coin thrown-in speed and an inclined angle (descending inclined angle) of the rotation type coin receiving cylinder 60 are large. However, as far as the coins are not thrown therein in rapid succession, since there is no interference among the coins, even if the thrown-in coin directly collides against the edge pressing plate 73 or housed upright coin CN', finally, since the coin stays in one of hollow sections T among the protruding strips as a seat portion through the rebounding thereof, thereafter, the coin is positively changed to an upright state and stacked while rotating through re-collision against the edge pressing plate 73 or the housed upright coins CN'.

Incidentally, when the rotation cylinder is rotated under a state where a peripheral edge front portion of the fallen coin is lying on the coin feed protruding strip, the coin feed protruding strip slides out under the fallen coin to a direction apart therefrom, so that the cover covering the peripheral edge front portion of the fallen coin is removed and the coin naturally is received in the hollow section between the protruding strips. On the contrary, when the rotation cylinder is rotated under a state where a peripheral edge rear portion of the fallen coin is deeply lying on the coin feed protruding strip, since the coin feed protruding strip is rotated with the fallen coin thereon, the coin is inclined in its side surface and gets over the coin feed protruding strip to stay in the next hollow section between the coin feed protruding strips.

And, in case the rotation type coin receiving cylinder 60 is a long cylinder, a sideways stacking function (orderly housing function) of the upright coins CN' can be obtained sufficiently to thereby have significance as the coin receiving cylinder.

In this case, since the rotation cylinders are disposed in the horizontal direction not in the vertical direction, it is possible to arrange the coins in the orderly stacked state in the predetermined number as well as greatly reduce the height of the coin housing portion. Further, since the coin receiving cylinders 60 can be installed substantially horizontally, it is possible to manufacture a device having a height of the order of two times as much as a diameter of the coins. Also, a driving system for rotating the rotating cylinder can be simplified when compared with a system where a discharging belt is used in the coin housing portion, which also contributes to miniaturization of the width dimension of the coin housing portion.

As shown in FIG. 12(*c*), since a stacked rotating upright coin runs on the coin feed protruding strip S whenever the coin receiving cylinder 60 rotates, wave motions of vertical vibrations are caused to the sideway stacked coins. Such vertical vibrations of the coins CN' release a pressure force against the upright coin CN" adjacent to the edge pressing plate 73 due to the accumulated load (which is reduced when the inclined angle is gentle) of the stacked coins, and contribute to synchronous discharge of the coin in its surface direction like a tumbler. Also, foreign matters, such as dust, adhered to the coins CN' are taken off through mutual friction of the coins to thereby clean the coins and facilitate the discharge operation of the upright coin at the foremost end.

Next, in the coin paying process, although one of the coin discharging portions 70A–70F is operated so that an upright coin is discharged upward from a corresponding one of the rotation type coin receiving cylinders 60A–60F and falls on the narrow coin transfer belt 81 of the paying-coin transfer portion 80, since the belt 81 has a very narrow space between both sides thereof, the dropped coin is held in its upright state and transferred to the coin paying port 7 at a high speed. In the transfer process, since the coin transfer belt 81 is provided with coin-rotation preventing projections 81*a* on its surface, there is no possibility of the upright coin being reversely rotated, and the upright coin is transferred at the same speed as that of the belt transfer. Also, use of the narrow coin transfer belt 81 contributes to the reduction of the space.

As described hereinabove, in the circulation type coin receiving and paying process portion 30, since inclined or substantially horizontal rotation type coin receiving cylinders are employed as a coin receiving system, coins can be housed in an orderly stacked state with a predetermined number, and a height of the device can be greatly reduced. Also, high speeds for receiving and discharging the coins can be attained.

The plural rotation type coin receiving cylinders 60 according to the respective denominations are arranged in a horizontally crossing direction in a case toward an inner direction, the coin receiving ports X on the upper side edges of the respective rotation type coin receiving cylinders 60 are positioned on a side of path 51 extending from the front to the back direction, and the coin discharge ports Y on the lower side edges of the respective rotation type coin receiving cylinders 60 are disposed on a side of the paying-coin transfer portion 80 extending from the back to the front direction. Therefore, it is not necessary to provide the coin sorting portion 50 in a back portion crossing direction, but it is possible to provide the coin sorting portion 50 extending from the front to the back direction, so that an occupying space of the rotation type coin receiving-paying process portion 30 can be reduced. Particularly, since the coin sorting portion 50 is located on a side of the circulation type bill receiving-paying process portion 20 and the paying-coin transfer portion 80 is disposed on a side of side wall 9*b* of the case, the bill receiving port 2 and the coin receiving port 6 can be provided in line on the right and left sides of the front portion of the machine thus improving money paying operations.

And, since the money receiving-paying machine 1 of the present embodiment is constructed such that the above-described thin compact circulation type bill receiving-paying process portion 30 and the thin compact circulation type coin receiving-paying process portion 30 are aligned side by side, the machine of the present embodiment can have the same dimension as that of a cash drawer box as shown in FIG. 13. Different from the conventional cash drawer box, the machine of the present embodiment can be provided with a POS terminal 11 thereon, and can be easily introduced into the existing POS system.

Second Embodiment

Figure 14B:
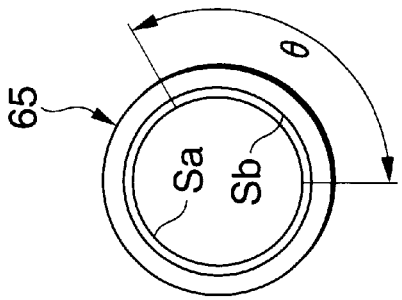
FIG. 14(*a*) is a vertical section view showing a second embodiment of a rotation type coin receiving cylinder of the circulation type coin receiving-paying machine.
Figure 14A:
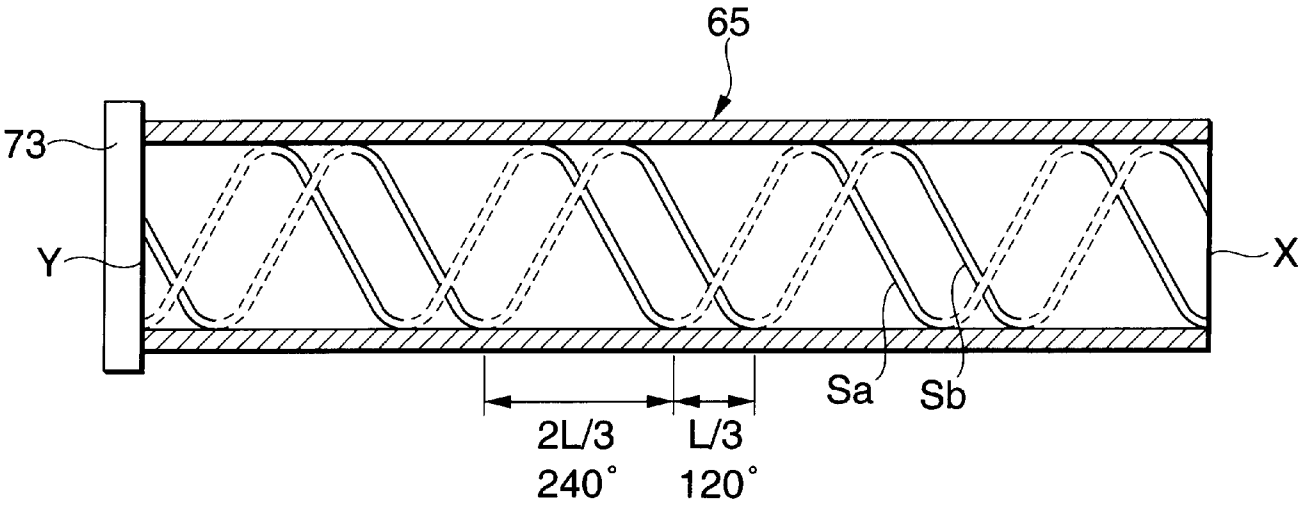

FIG. 14(*a*) is a vertical section view showing a second embodiment of a rotation type coin receiving cylinder of the circulation type coin receiving-paying process portion 30, and FIG. 14(*b*) is a front view thereof.

In an inner peripheral surface of the rotation type coin receiving cylinder 65 of the present embodiment are provided a first (front side) spiral coin feed protruding strip $S_a$, and a second (rear side) spiral coin feed protruding strip $S_b$ adjacent thereto on a side of the coin receiving port X with a phase difference of $\theta=120°$ from the first coin feed protruding strip $S_a$, i.e. two spiral strips are provided with an unequal phase difference instead of 180° phase difference. The first coin feed protruding strip $S_a$ and the second coin feed protruding strip $S_b$ are made of a metal spiral wire material.

In case a plurality of coins CN is thrown into the coin receiving port X of the rotation type coin receiving cylinder 65, as shown in FIG. 15(*a*-1), the plural coins CN are placed on a hollow section (seat portion) T between the coin feed protruding strips $S_b$ and $S_a$ in the vicinity of the coin receiving port X in a partially overlapped state with lifted rear portion. Although the last coin $CN_o$ is transferred in an axial direction in a state that a rear part thereof lies on the first coin feed protruding strip $S_a$, since the second coin feed protruding strip $S_b$ adjacent thereto in its back side is close to the first coin feed protruding strip $S_a$, the last coin $CN_o$ is transferred to the axial direction in a state that the rear portion thereof also lies on the second coin feed protruding strip $S_b$ at the same time. More specifically, the rear portion of any coin $CN_o$ among the thrown-in plural coins lies on the first coin feed protruding strip $S_a$ and the second coin feed protruding strip $S_b$ to be lifted in the rear portion, so that an upper side $f_1$ of a peripheral edge on the lifted one-shoulder side of the rear-part lifted coin $CN_o$ contacts the first coin feed protruding strip $S_a$ to be supported, a lower side $f_2$ of the peripheral edge on a fallen one-shoulder side of the coin $CN_o$ contacts the second coin feed protruding strip $S_b$, and a lower part of the peripheral edge is in contact with the hollow section T between the protruding strips. Such postured coin $CN_o$ with the lifted rear part pushes the partially overlapped coins CN to transfer to the axial direction.

When a leading coin CN collies against a housed upright coin CN" as a coin hitting-receiving device, the coins are stacked with widely overlapping portions; as shown in FIGS. 15(*a*-2), 15(*b*-2), 15(*a*-3) and 15(*b*-3), the left and right rear portions of the last coin $CN_o$ are lifted while being twisted by the first and second coin feed protruding strips $S_a$ and $S_b$ with the front portion of the leading coin CN as a lower base point; and as shown in FIGS. 16(*a*-4) and 16(*b*-4), the upper portion of the leading coin CN' abuts against the housed upright coin CN" to thereby lean thereon and then to be reversed. Then, the lower part of the last coin $CN_o$' in a state of immediate-before standing is adjusted by the second coin feed protruding strip $S_b$, so that the thrown-in coins are stacked to the housed upright coins CN" in an upright state, i.e., surfaces of the transferred coins are stacked to the surfaces of the housed upright coins CN".

As described hereinabove, even in case the plural fallen coins CN are transferred in an axial direction, since the plural coins become in the upright state after the coins are once going to be reversed simultaneously with the collision, the lowest (the last) coin $CN_o$ is reversed and at the same time the coins stacked on the upper side thereof are reversed, so that the plural coins stand up simultaneously. Therefore, even if plural coins are thrown in together, since the coins can be made upright at a stroke in the overlapped state, the rotation cylinders can be shortened. Also, since operation of the edge adjustment after the collision of the coins can be carried out slowly instead of vigorously, the rotation speed can be reduced, which results in reduced electric consumption and noise.

In the rotation type coin receiving cylinders 60 of Embodiment 1, there is employed an upright posture change system wherein the back surface side of a front-portion lifted fallen coin is stacked to the coin hitting-receiving device or the like when collided. Although the situation is liable to occur in case a space (pitch) between adjacent coin feed protruding strips is large when compared with a diameter d of the coin, in the present embodiment, there is employed a fallen-upright posture change system wherein the surface side of the rear-portion lifted fallen coin is stacked to the coin hitting-receiving device or the like after having been reversed at a time of collision. The situation is liable to occur in case a space between the first coin feed protruding strip $S_a$ and the second coin feed protruding strip $S_b$ adjacent thereto on the side of the coin receiving port X is small when compared with a diameter d of the coin. However, in case an adjacent space between the second coin feed protruding strip $S_b$ and the first coin feed protruding strip $S_a$ on the side of the coin receiving port X is smaller than the diameter d of the coin, and the fallen coin CN is mounted over the second coin feed protruding strip $S_b$ and the first coin feed protruding strip $S_a$ on the side of the coin receiving port X, the coin collides in the front-portion lifted state and the erect posture change system may be carried out.

Therefore, when an adjacent space between the first coin feed protruding strip $S_a$ and the second coin feed protruding strip $S_b$ on the side of the coin receiving port X is made narrower than a diameter d of a handling coin, and an adjacent space between the second coin feed protruding strip $S_b$ and the first coin feed protruding strip $S_a$ on the side of the coin receiving port X is made wider than the diameter d of the handling coin, the coins are transferred in the rear-portion lifted posture in most cases to be housed in an upright state by the fallen-upright posture change mode, and the erect posture change hardly takes place. In such a case, it is possible to house the plural coins in a stroke in an upright state to thereby shorten the length of the rotation cylinders or reduce the rotation speed thereof.

Normally, since a lead angle β of the coin feed protruding strips $S_a$, $S_b$ is about 45°, a phase difference of the second coin feed protruding strip $S_b$ on the side of the coin receiving port X with respect to the first coin feed protruding strip $S_a$ is suitable to be 100°–140°.

Third Embodiment

Figure 17:
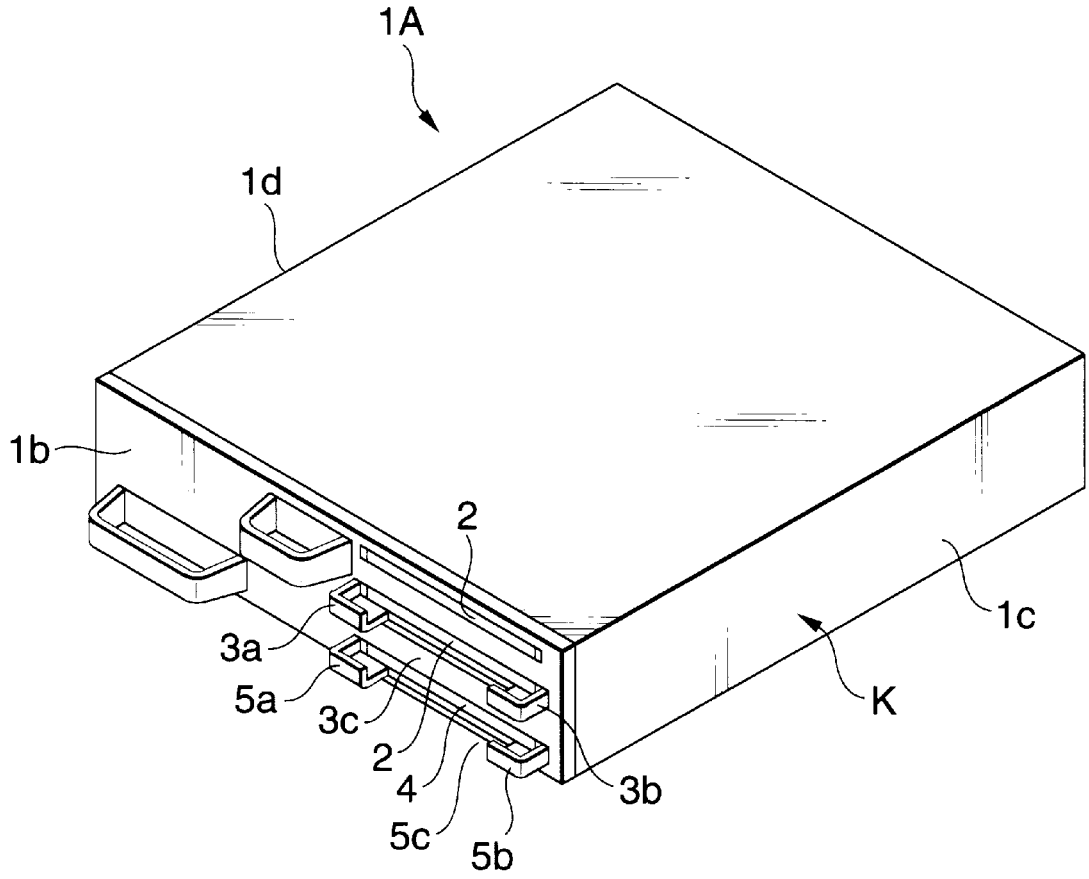
FIG. 17 is a perspective view showing a contour of a money receiving-paying machine according to a third embodiment of the invention.
Figure 18:
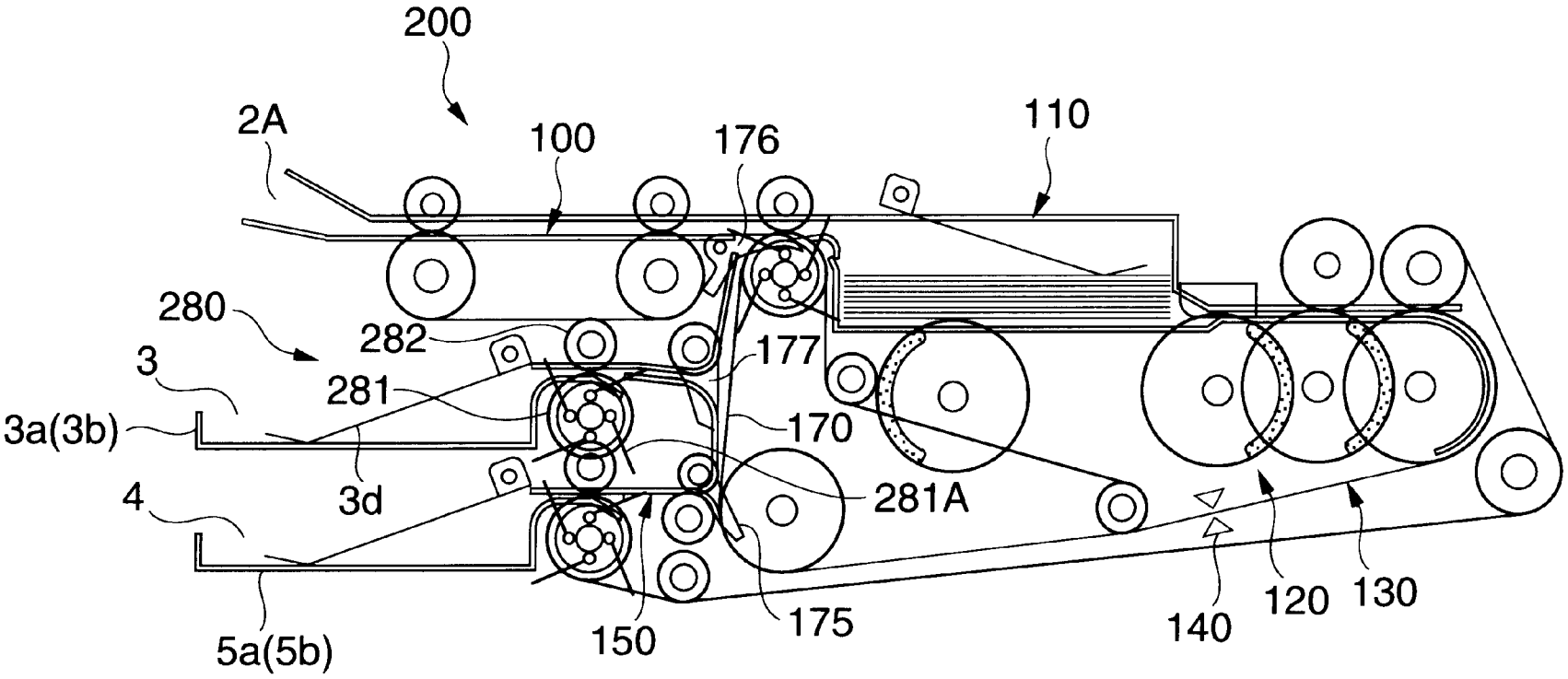
FIG. 18 is a vertical section side view showing a circulation type bill receiving-paying process portion of the money receiving-paying machine.

FIG. 17 is a perspective view showing a contour of a money receiving-paying machine according to the third embodiment of the invention; and FIG. 18 is a vertical section side view showing a circulation type bill receiving-paying process portion of the money receiving-paying machine.

The money receiving-paying machine 1A of the present embodiment is different from the money receiving-paying machine 1 of the first embodiment in that a slit of the second bill paying port 3 is provided with bill edge receiving projections 3*a*, 3*b* at both ends thereof and a center hollow portion 3*c* therebetween so that the bills discharged to the paying port 3 can be held by a hand. Therefore, a plurality of bills can be stacked on the second bill paying port 3.

Also, in the circulation type bill receiving-paying process portion 200 of the present embodiment, different from the circulation type bill receiving-paying process portion 20 according to the first embodiment 1, a second paying-bill transferring path 280 for guiding a bill from a second changeover gate 177 in the middle of the returning-bill transferring path 170 to the second bill paying port 3 includes a lower-side impeller 281 provided with elastic vanes 281A for striking down the bills discharged to the second bill paying port 3; and an upper-side pressure contact roller 282 to be in pressure contact therewith. Incidentally, there is provided a leaf spring 3d for pressing the bills discharged to the second bill paying port 3 from an upper side.

Although bills can not be held immediately before the port since a length of the second paying-bill transferring path 280 becomes shorter than a bill short-side length, a plurality of 5,000-yen bills and 10,000-yen bills can be stacked in the second bill paying port 3.

Incidentally, in the circulation type bill receiving-paying process portion 20 according to the first embodiment 1, since the second bill paying port 3 is for exclusive use for 5,000-yen bills and 10,000-yen bills once discharged are returned to the housing portion 110 through the returning-bill transferring path 170, unused 10,000-yen bills are held in the housing portion 110, so that as the number of bill receiving processes is increased, the number of 10,000-yen bills held in the housing portion 110 is increased and there is a risk of a shortage of lower denomination bills at the time of bill-paying process.

However, in the present embodiment, in addition to the normal paying process, by making one cycle of the received bills to inspect the existing bills in the housing portion 110 (high denomination bill thinning-out mode), when a 10,000-yen bill is discharged from the housing portion 110, the 10,000-yen bill can be discharged to the second bill paying port 3 through the returning-bill transferring path 170 and the second paying-bill transferring path 280, so that the high denomination bills can be removed from the housing portion 110. Thus, the shortage of the low denomination bills at the paying process can be dissolved, and the paying process can be carried out repeatedly.

Fourth Embodiment

Figure 19:
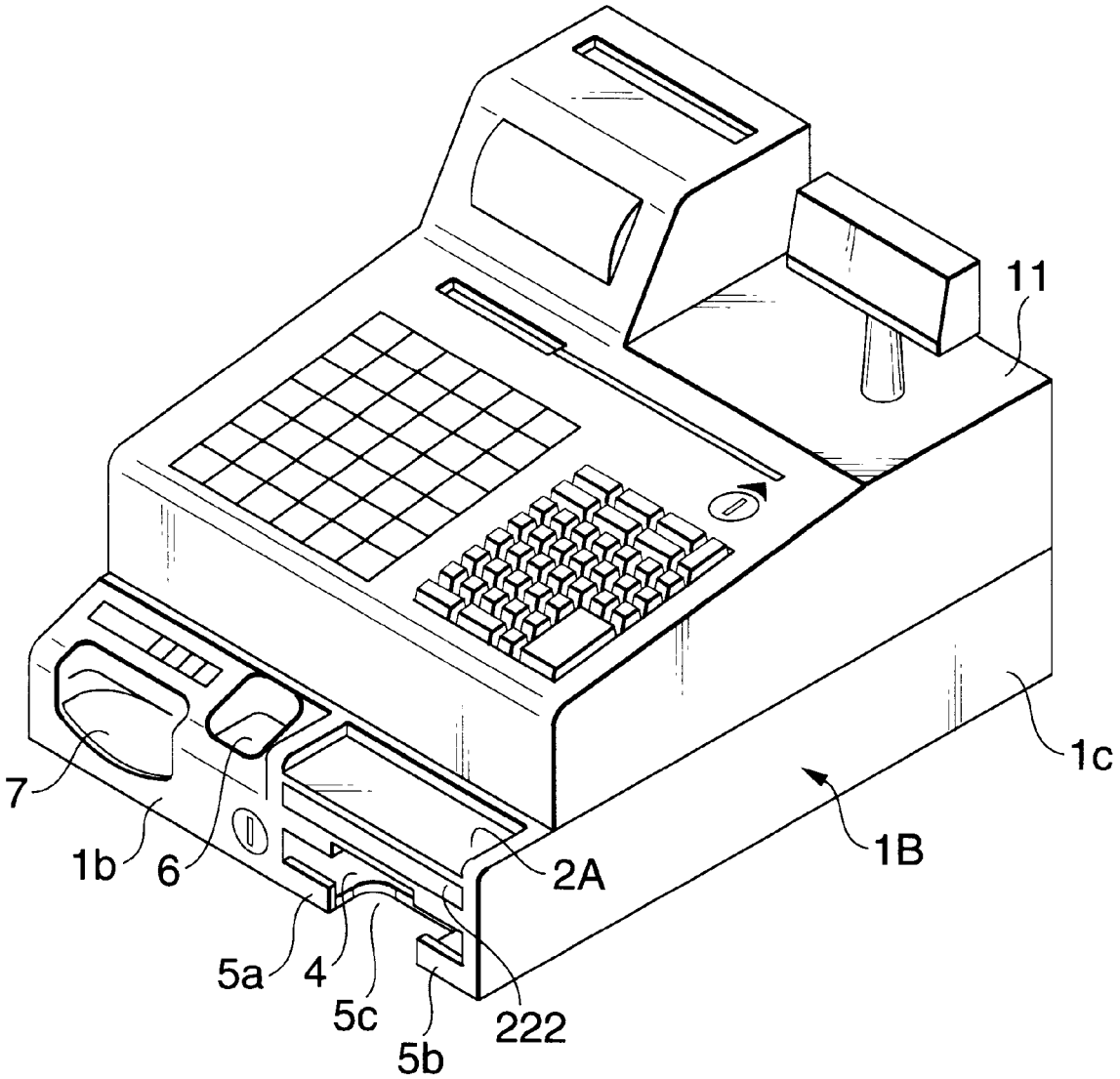
FIG. 19 is a perspective view showing a state wherein a POS terminal is installed on a money receiving-paying machine according to a forth embodiment of the present invention.
Figure 20:
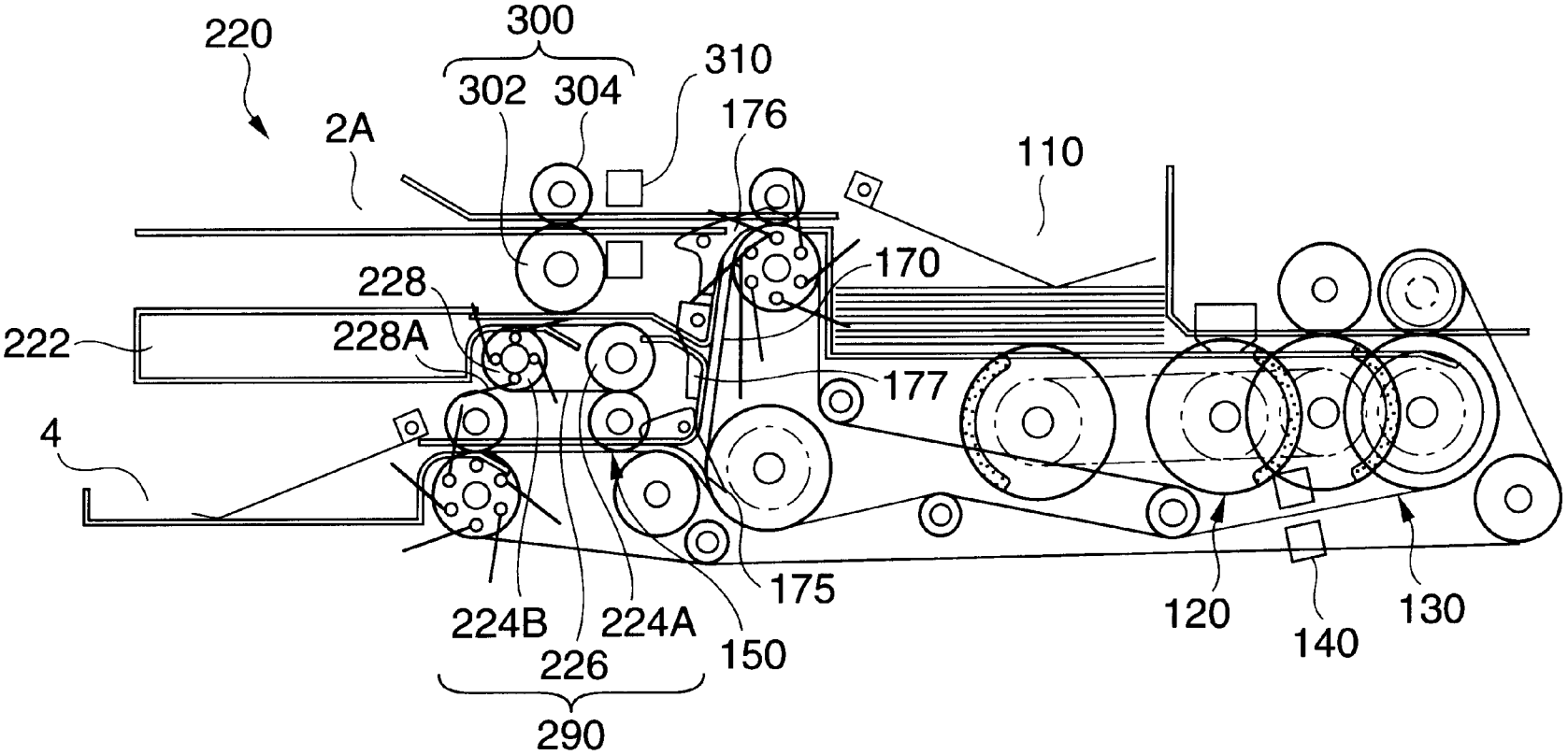
FIG. 20 is a vertical section side view showing a circulation type bill receiving-paying process portion of the money receiving-paying machine.

FIG. 19 is a perspective view showing a contour of a money receiving-paying machine according to a forth embodiment of the present invention, and FIG. 20 is a vertical section side view showing a circulation type bill receiving-paying process portion of the money receiving-paying machine.

A front portion of a money receiving-paying machine 1B of the present embodiment slightly projects forward from a front surface of a POS terminal 11, and a bill receiving port 2A is formed on an upper surface of the front portion in a depressed shape. A circulation type bill receiving-paying process portion 220 is provided with a second bill housing portion 222, instead of the first bill paying port 3 in the third embodiment, and the bill housing portion 222 is a closed type housing portion with a lock. A second paying-bill transferring path 290 for guiding a bill to the second bill housing portion 222 includes a bill transferring belt 226 extended between a pulley 224A on a side of a second changeover gate 177 and a pulley 224B on a side of the bill housing portion 222; and a lower-side impeller 228 having the pulley 224B and elastic vanes 228A for striking down the bill to be discharged to the second bill paying port 222. Also, a receiving-bill transferring portion 300 includes a lower side drawing-in roller 302 and an upper side press contact roller 304 to be pressed thereby. And, there is provided a received-bill identifying portion 310 for identifying denominations and genuineness of bills.

In such a circulation type bill receiving-paying process portion 220, when a bill is inserted into the bill receiving port 2*a*, the bill is drawn in by the drawing-in roller 302 to be transferred, the drawn-in bill is identified at the received-bill identifying portion 310, and housed in a circulation type bill housing portion 110. In case a 10,000-yen bill is received, the 10,000-yen bill is discharged from the housing portion 110 by the high denomination bill thinning-out mode, returned to the returning-bill transferring path 170 through the first changeover gate 175, and then housed in the second bill housing portion 222 through the second changeover gate 177. Also, in case the number of 5,000-yen bills in the housing portion 110 exceeds what is necessary, the 5,000-yen bills are transferred to the second bill housing portion 222 to be held therein by the high denomination bill thinning-out mode. Since the numbers of the bills of respective denominations in the second bill housing portion 222 are known, when the number of the bills housed in the second bill housing portion 222 is increased, the second bill housing portion 222 is unlocked by a key, and the bills housed therein can be removed. Since the second bill housing portion 222 can be locked, security of the high denomination bill housing can be maintained.

Fifth Embodiment

Figure 21:
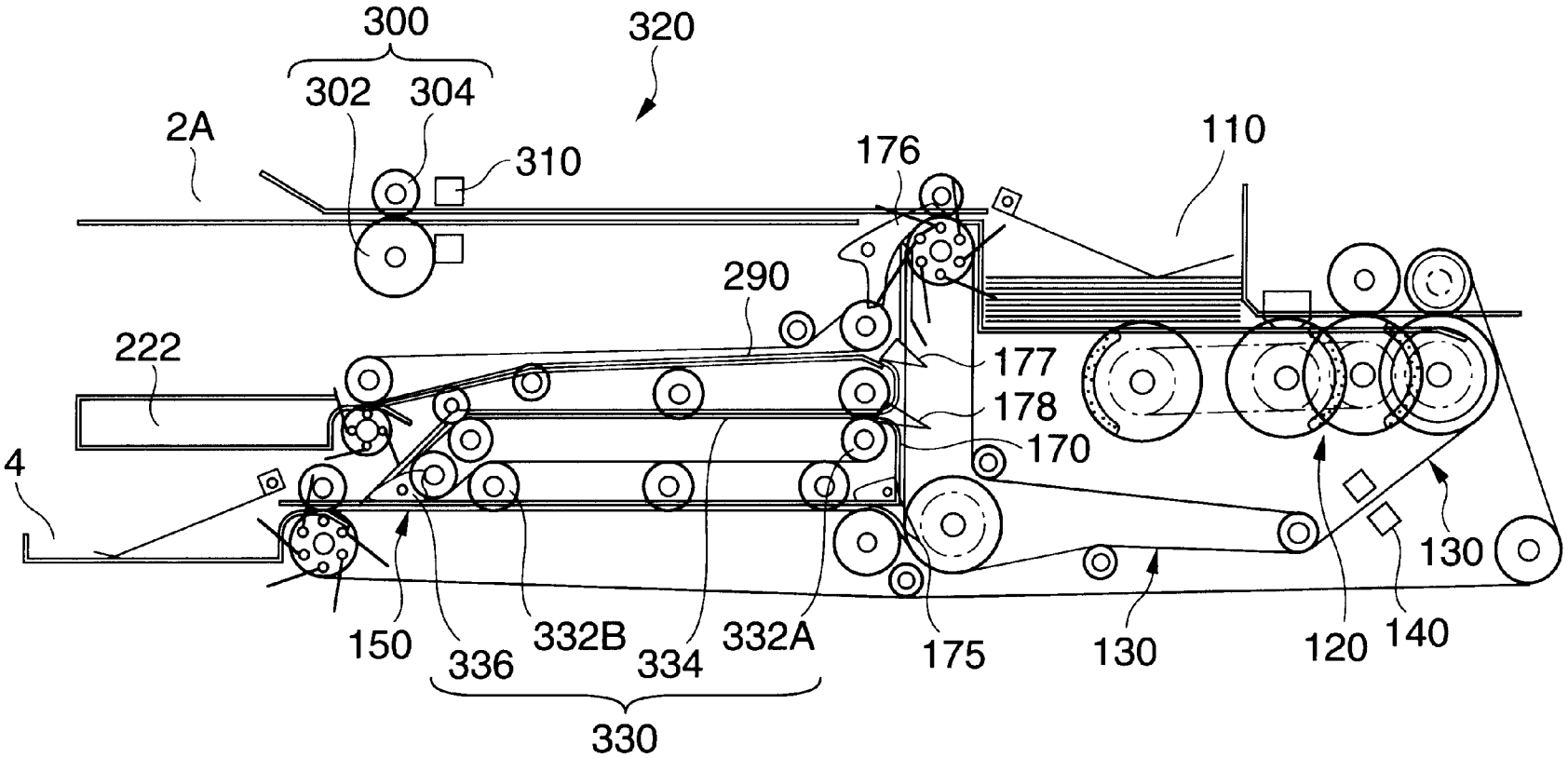
FIG. 21 is a vertical section side view showing a circulation type bill receiving-paying process portion of a money receiving-paying machine according to a fifth embodiment of the invention.

FIG. 21 is a vertical section side view showing a circulation type bill receiving-paying process portion of a money receiving-paying machine of a fifth embodiment of the present invention.

In a circulation type bill receiving-paying process portion 320 of the present embodiment, in addition to the structure of the circulation type bill receiving-paying process portion 220 of the fourth embodiment as shown in FIG. 20 is provided a third changeover gate 178 for distributing a 5,000-yen bill from the first changeover gate 175 in the middle of the first changeover gate 175 and the second changeover gate 177 of the returning-bill transferring portion 170 to either a forward portion of the returning-bill transferring portion 170 or a third paying-bill transferring portion 330. The third paying-bill transferring portion 330 includes a bill transferring belt 334 extended between a pulley 332A on a side of the third changeover gate 178 and a pulley 332B on a side of the bill paying port 4; and a merging point changeover gate 336 on a side of the end of the first bill paying transferring portion 150. The bill transferring belt 334 is longer than the short-side length of the 5,000-yen bill, so that the third paying-bill transferring portion 330 functions as an immediate-before holding portion of the 5,000-yen bill.

In the structure as described hereinabove, although the 10,000-yen bills sent out from the housing portion 110 are transferred to the second bill housing portion 222 to be housed therein, the 5,000-yen bills sent out from the housing portion 110 are held at the third paying-bill transferring portion 330 through the third changeover gate 178. When the 5,000-yen bills are paid, the 5,000-yen bills held in the third paying-bill transferring portion 330 are instantly transferred to the bill paying port 4. In the bill paying process, high denomination bills can be paid earlier than the low denomination bills.

Sixth Embodiment

Figure 22:
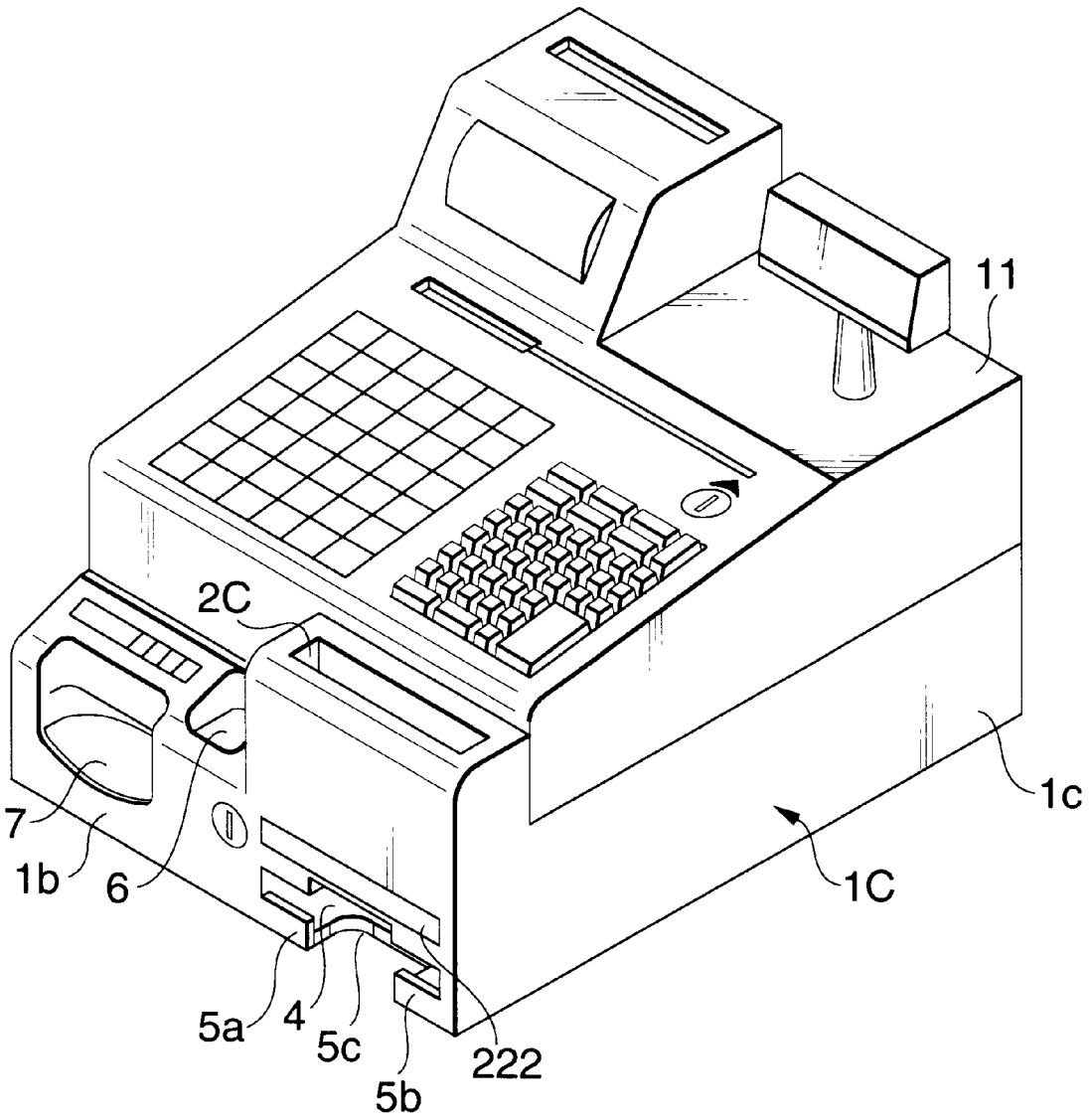
FIG. 22 is a perspective view showing a state wherein a POS terminal is installed on a money receiving-paying machine according to a sixth embodiment of the invention.
Figure 23:
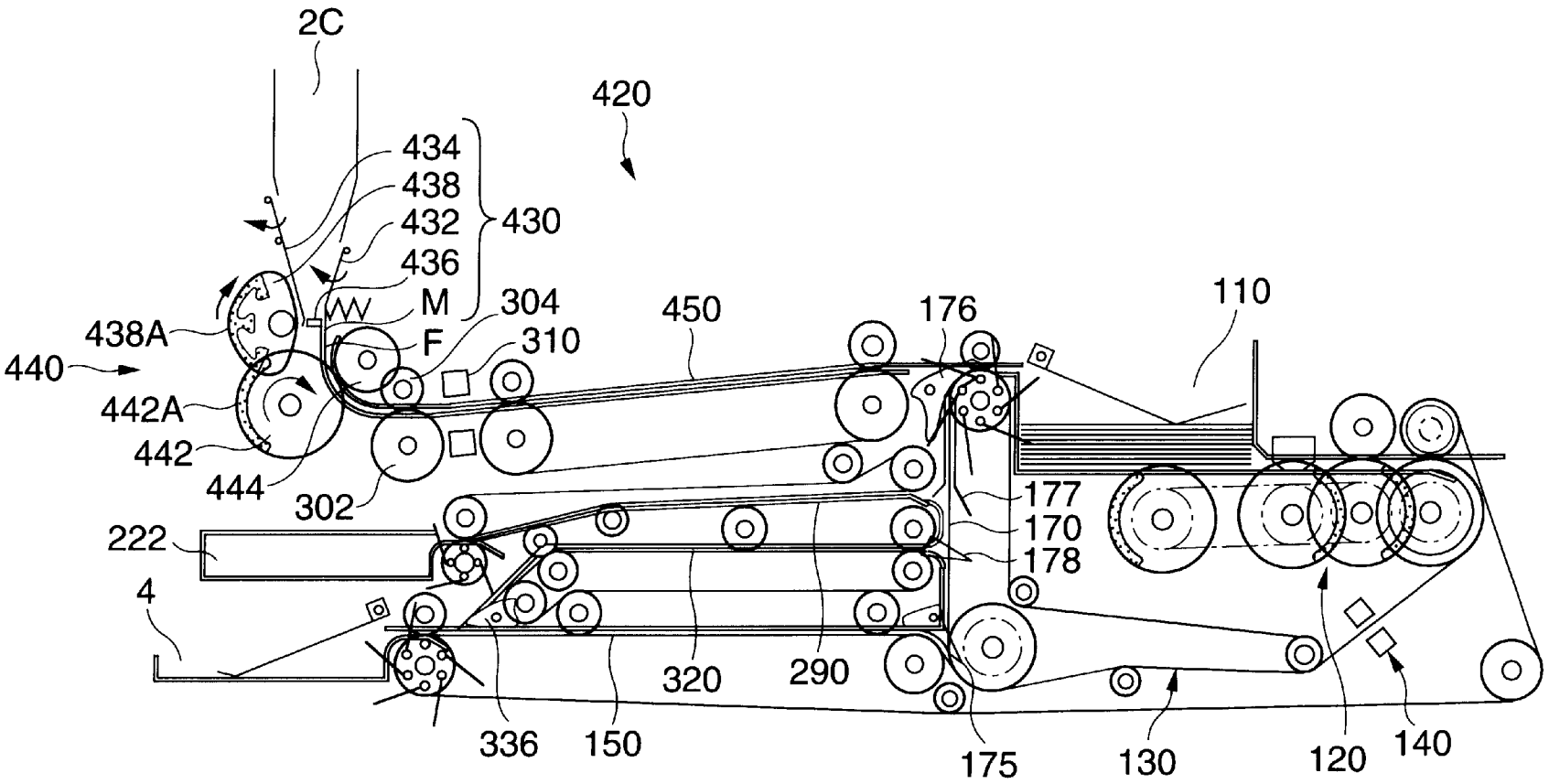
FIG. 23 is a vertical section side view showing a circulation type bill receiving-paying process portion of the money receiving-paying machine.

FIG. 22 is a perspective view showing a contour of a money receiving-paying machine according to a sixth embodiment of the present invention, and FIG. 23 is a vertical section side view showing a circulation type bill receiving-paying process portion of the money receiving-paying machine.

The money receiving-paying machine 1C according to the present embodiment, different from the money receiving-paying machines according to the fourth and fifth embodiments as shown in FIG. 19, has a plural bill inserting port 2C wherein receiving bills are dropped in. And, in a circulation type bill receiving-paying process portion 420, to the bill receiving-paying process portion 320 of the fifth embodiment are added a plural bill inserting portion 430 and a received bill separating portion 440.

The plural bill inserting portion 430 includes a first elastic flap 432 and a second elastic flap 434 which are opened at the plural bill inserting port 2C and elastically urged to be rotated toward arrow directions with upper edge sides as their centers as shown in the drawing; a convex bottom plate 436 for receiving approximately center portions of long-side edges of inserted bills; and a kick roller 438 for rotating the second elastic flap 434 in a direction opposite to the arrow direction to align the vertically stacked bills against an urging force of the first elastic flap 432 and drop the bills into a port M of a downwardly bill-transferring path, and, at the same time, kicking out the bills downward along the surface thereof in contact with a high friction coefficient material 438A.

The received bill separating portion 440 includes a feed roller 442 for receiving a forward edge of the bill kicked out by the kick roller 438 at a press contact roll-in area F and feeding the bill while preventing double feeding thereof; and a preventing roller 444. The feed roller 442 is provided with a high friction coefficient material 442A along a circular arc peripheral surface of the feed roller 442. And also, in the rear portion of a received-bill identifying portion 310 of the present embodiment, a received-bill transfer belt 450 is provided.

In the circulation type bill receiving-paying process portion 420 as described above, when a plurality of bills is thrown into the plural bill insertion port 2C at the same time, a sensor (not shown) detects the bills; the kick roller 438 starts rotating in an arrow direction in FIG. 4; since a cam surface of a circular arc cutoff part pushes the second elastic flap 434 as a cam follower in a left direction against a spring urging force thereof, lower edges of the bills are brought to the side of the first elastic flap 432 on the bottom plate 436; when the kick roller 438 is further rotated, the lower portions of the bills are forced out of the bottom plate 436 in a sandwiched state between the first elastic flap 432 and the second elastic flap 434; and since the high friction coefficient material 438A of the kick roller 438 frictionally contacts a bill surface, the bill is kicked out downward along the surface thereof to be inserted into the port M of the downwardly bill-transferring path. Since the forward edge of the inserted bill abuts against the press contact roll-in area F between the feed roller 442 synchronously rotated with the kick roller 438 and the non-rotatable preventing roller 444, only the bill contacting the high friction coefficient material 442A of the feed roller 442 is discharged, and transferred in an inner direction one by one by the roll-in roller 302 and the pressure contact roller 304.

As described hereinabove, since the present embodiment includes the plural bill inserting portion 430 and the received bill separating portion 440, even if a plurality of bills is inserted at the same time, the bill receiving process can be carried out quickly.

Seventh Embodiment

Figure 24:
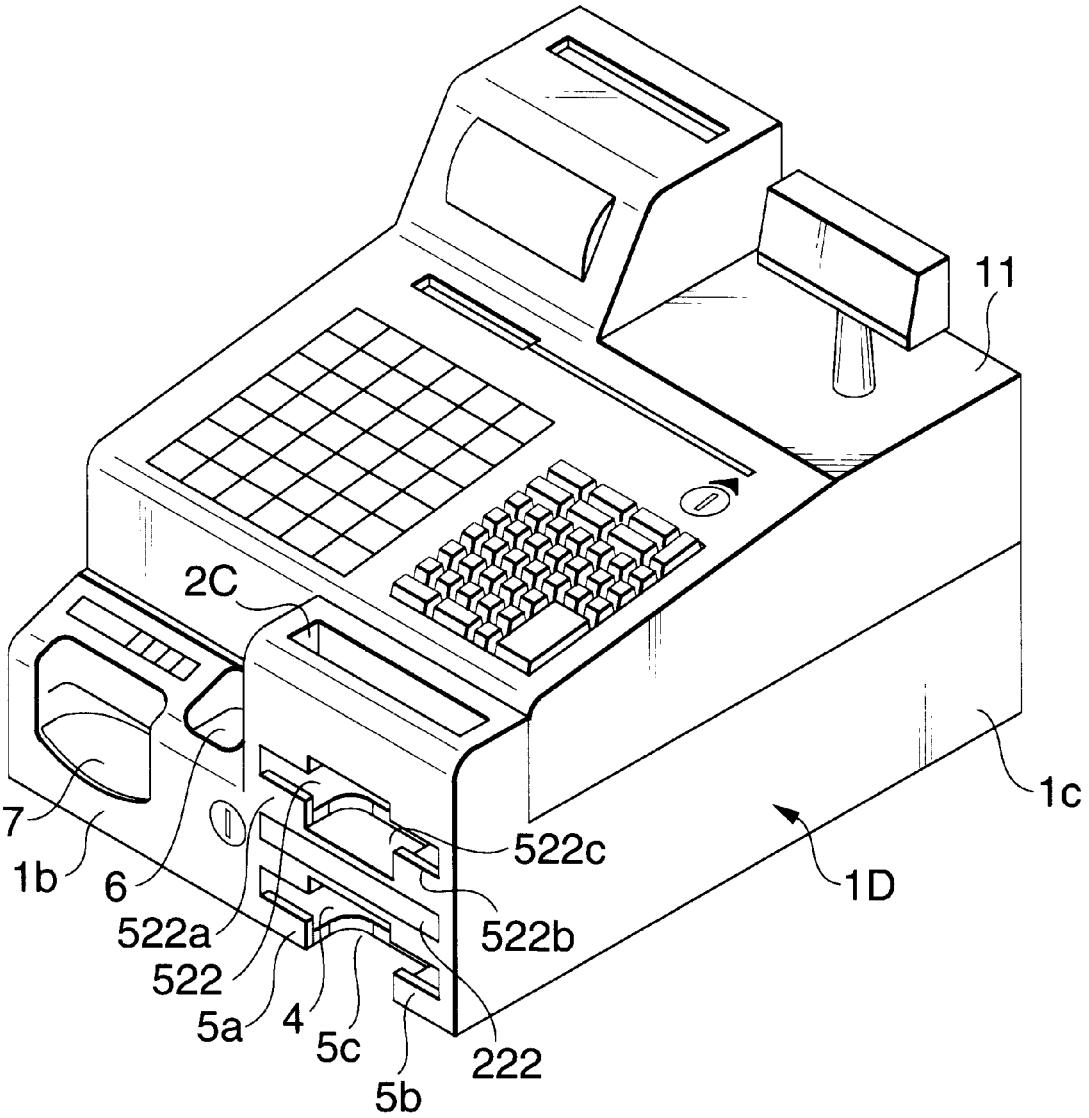
FIG. 24 is a perspective view showing a state wherein a POS terminal is installed on a money receiving-paying machine according to a seventh embodiment of the invention.
Figure 25:
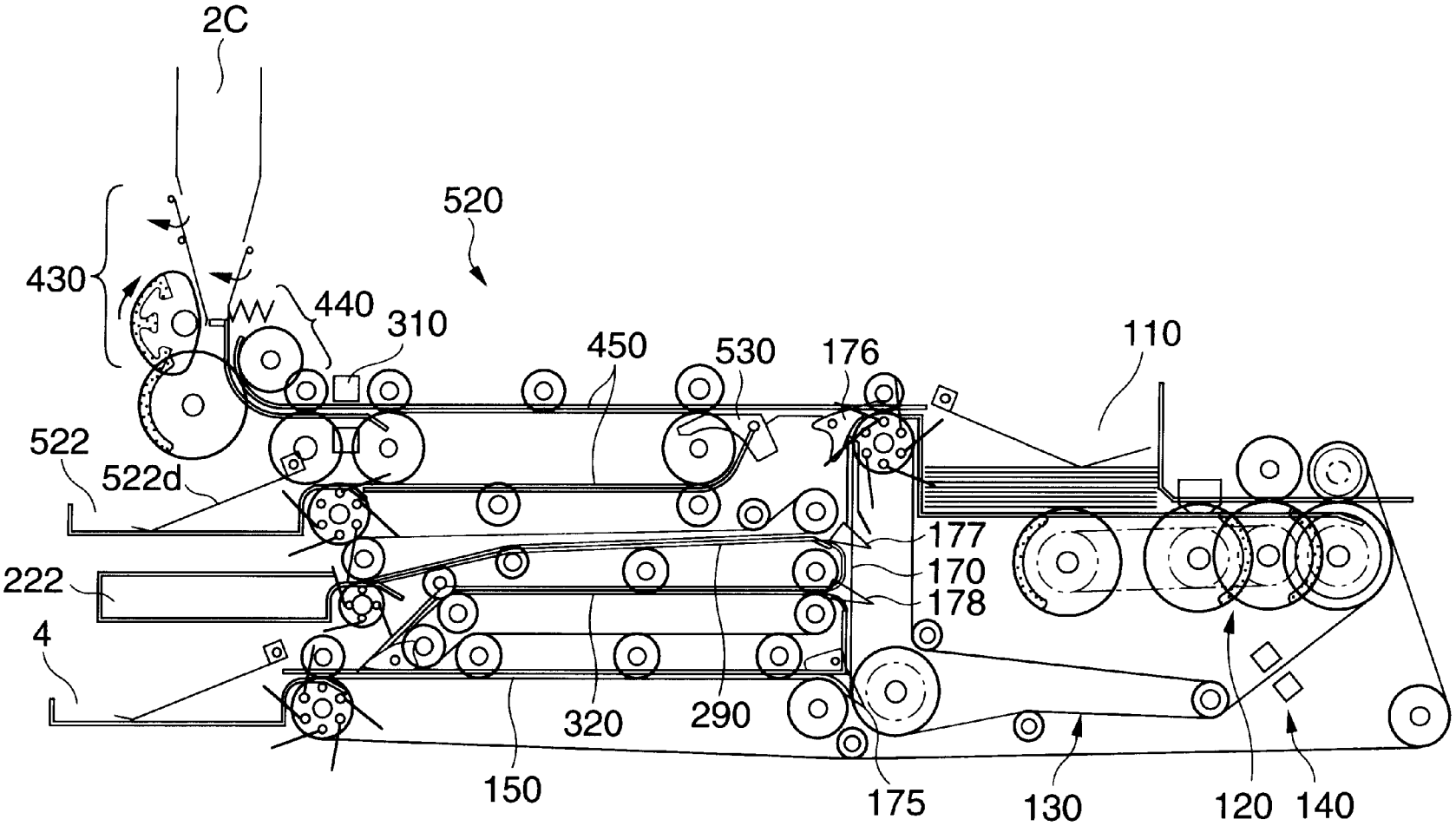
FIG. 25 is a vertical section side view showing a circulation type bill receiving-paying process portion of the money receiving-paying machine.

FIG. 24 is a perspective view showing a contour of a money receiving-paying machine according to a seventh embodiment of the present invention, and FIG. 25 is a vertical section side view showing a circulation type bill receiving-paying process portion of the money receiving-paying machine.

In a money receiving-paying machine 1D of the present embodiment, in addition to the money receiving-paying machine according to the sixth embodiment shown in FIG. 22 is provided a bill rejecting port 522 under the plural bill insertion port 2C on the front panel 1*b*. Bill edge receiving portions 522*a*, 522*b* are projectively provided on both edges of a slit for the bill rejecting port 522 and a center hollow portion 522*c* is formed therebetween to thereby hold bills discharged to the bill rejecting port 522 by a hand.

And, in the middle of the received-bill transfer portion of a circulation type bill receiving-paying process portion 520 of the present embodiment is provided a rejecting gate (fourth changeover gate) 530 for guiding a bill which can not be identified at a received-bill identifying portion 310 to the bill-rejecting port 522. The bill-rejecting port 522 is provided with a leaf spring 522*d* for pressing the discharged bills from an upper side.

Generally, after a clerk at a counter examines the genuineness of bills received from a customer, the bills are subjected to the bill receiving process, so that there is no risk of unidentified bills being housed in the circulation type bill housing portion 110, but once the unidentified bills are housed in the circulation type bill housing portion 110, it takes some time to take out the bills therefrom. However, in the present embodiment, since the non-identified bills are instantly returned to the rejecting port 522, it is possible to quickly cope with use of false bills and the like. Incidentally, a rejected-bill housing portion may be provided instead of the bill rejecting port 522.

Eighth Embodiment

Figure 26A:
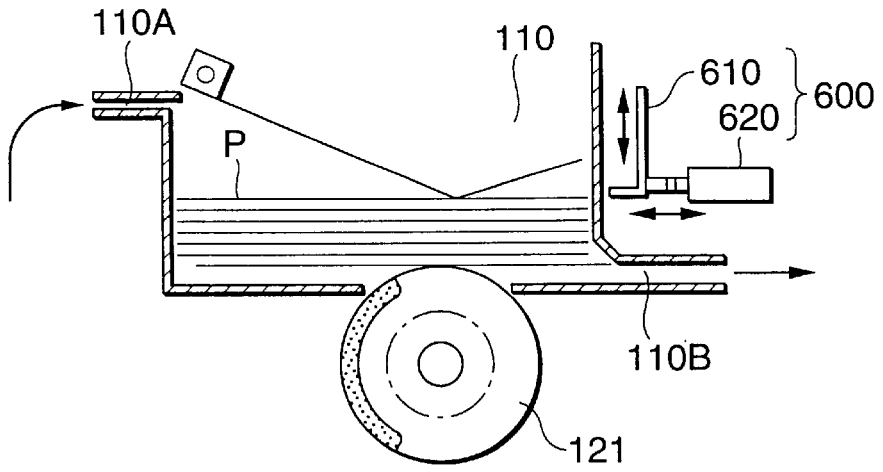
FIG. 26(*a*)–FIG. 26(*c*) are vertical section side views showing a circulation type bill housing portion of a circulation type bill receiving-paying process portion of a money receiving-paying machine according to an eighth embodiment of the invention, respectively.
Figure 26B:
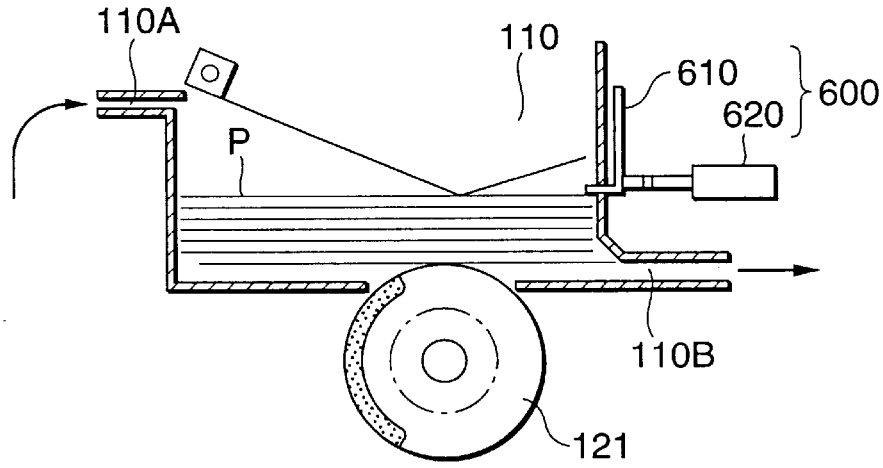
Figure 26C:
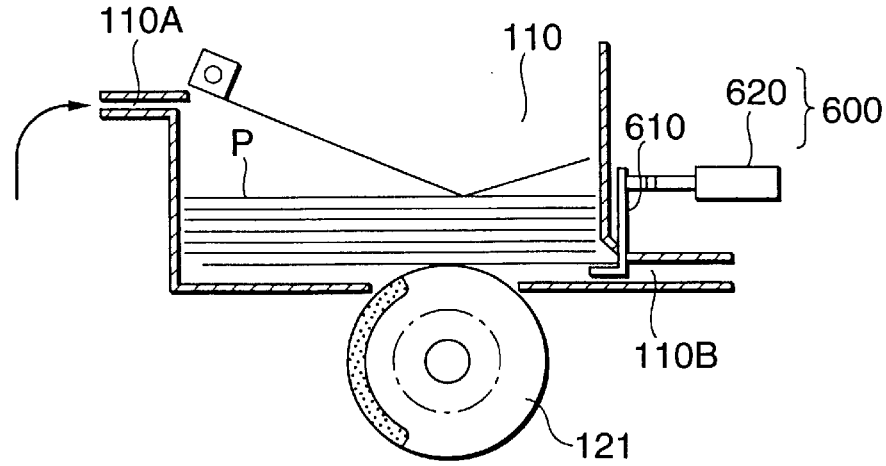

FIGS. 26(*a*)–26(*c*) are vertical section side views showing a circulation type bill housing portion of a circulation type bill receiving-paying process portion in a money receiving-paying machine according to an eighth embodiment of the present invention.

In the circulation type bill housing portion 110 of the present embodiment, a received-bill re-discharge rejecting mechanism 600 for closing a bill-paying path for the bills stacked higher than a reference surface is provided. The re-discharge rejecting mechanism 600 is placed on the bills P stacked in the circulation type bill housing portion 110, and includes an L-shape shutter plate 610 for automatically descending and closing the discharge port 110B through discharge (paying-out) of the bills stacked thereunder according to the discharging operation of the kick roller 121, and a shutter driving portion 620, such as a solenoid, for driving the shutter plate 610 in a retracting process.

When a clerk at a counter shifts, in order to compare a cash amount displayed on a register and a cash amount reserved in the register, it is necessary to count the total amount of the bills housed in the circulation type bill housing portion 110. Therefore, when the money receiving-paying machine is set to a received bill amount confirmation mode, the L-shape shutter plate 610 in a retracted state as shown in FIG. 26(*a*) is driven by the shutter driving portion 620, so that the L-shape shutter plate 610 is placed on the uppermost portion of the orderly stacked bills P in the housing portion 110 as shown in FIG. 26(*b*). And, through the kick-out operation of the kick roller 121, the orderly stacked bills in the housing portion 110 are discharged from the lowermost bill sequentially through the discharge port 110B. The discharged bills are returned to the housing portion 110 through the returning-bill transferring portion 170, and stacked on the L-shape shutter plate 610. Through such repetition of the bill circulation, since the bills stacked under the L-shape shutter plate 610 are sequentially discharged, the L-shape shutter plate 610 gradually descends, and finally reaches a bottom surface of the housing portion 110, so that the discharge port 110B is completely closed as shown in FIG. 26(*c*). Thereafter, even if the kick roller 121 is rotated, the discharge port 110B does not discharge. A fact that the discharge port does not discharge can be detected by the leaving-bill identifying portion 140, which means completion of one cycle of the bills P orderly stacked in the housing portion 110. Thereafter, the L-shape shutter plate 610 is returned to a retreated position by the shutter driving portion 620, and the bills in the housing portion 110 can be discharged, as shown in FIG. 26(*a*).

As described hereinabove, since the re-discharge rejecting mechanism 600 is provided in the present embodiment, collation of the received bills can be carried out whenever necessary.

Ninth Embodiment

Figure 27A:
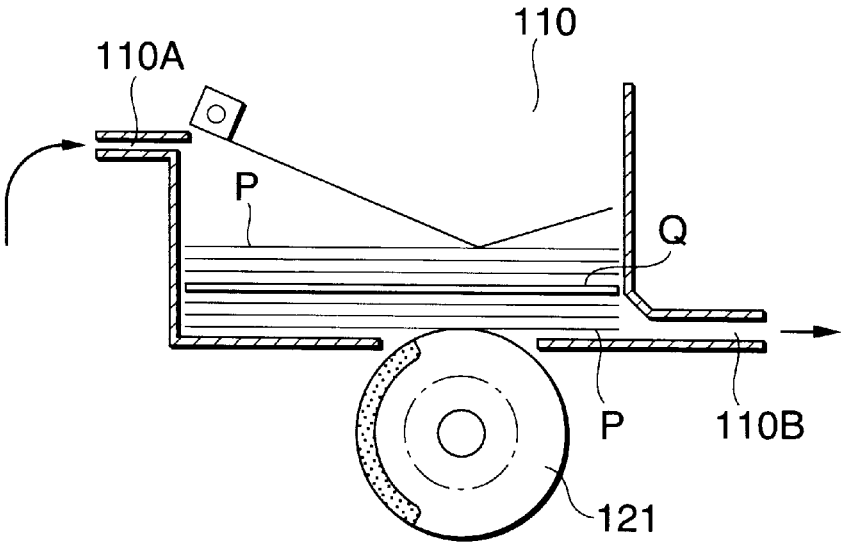
FIG. 27(*a*) and FIG. 27(*b*) are vertical section side views showing a circulation type bill receiving portion of a circulation type bill receiving-paying process portion of a money receiving-paying machine according to a ninth embodiment of the invention.
Figure 27B:
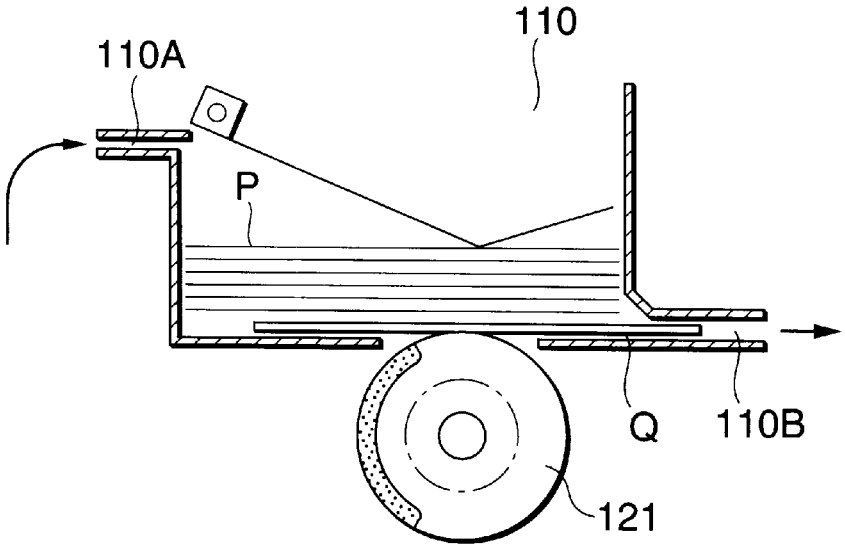
Figure 28:
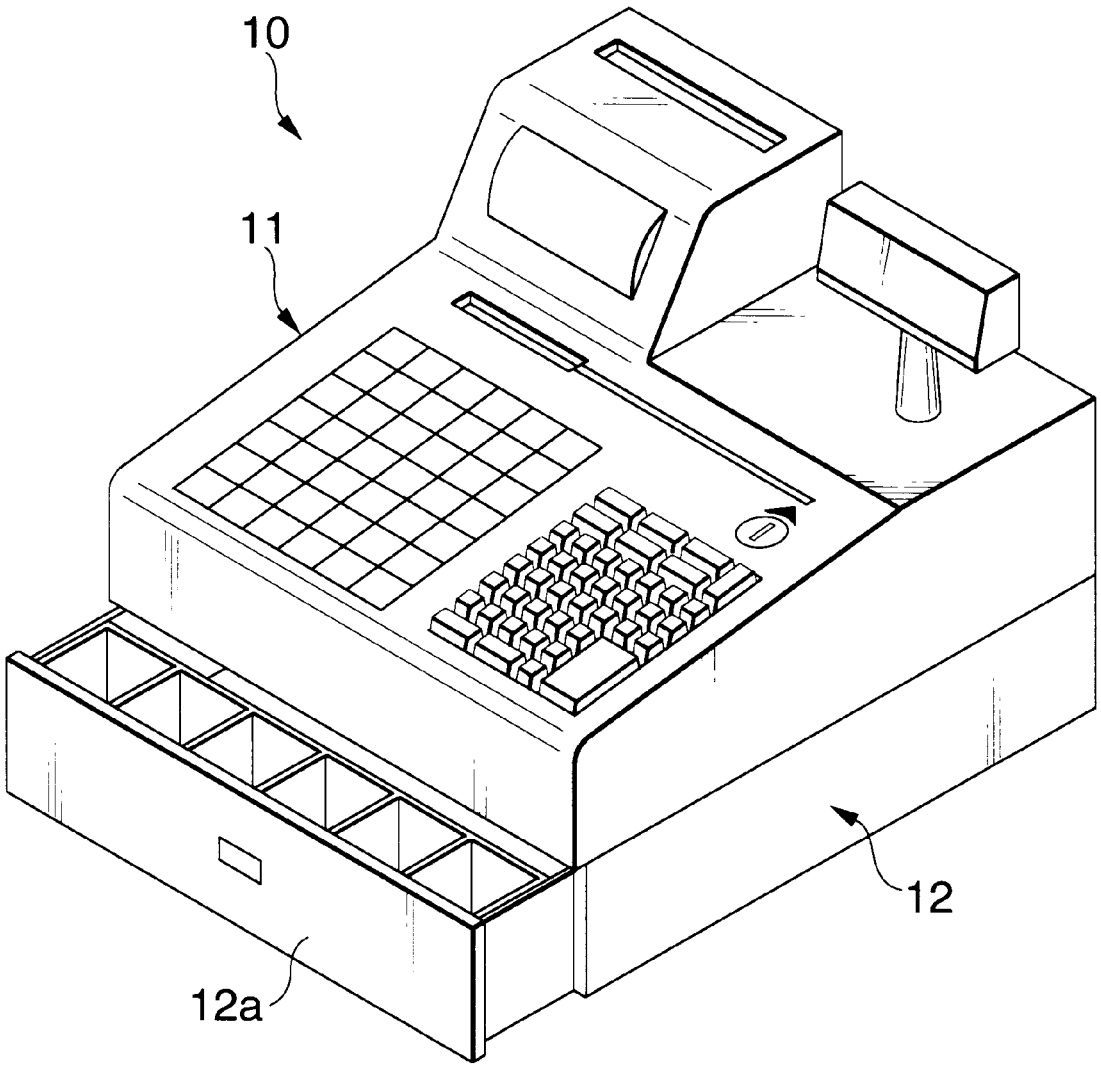
FIG.28 PRIOR ART
FIG. 28 is a perspective view showing a contour of a cash drawer type POS register.
Figure 29:
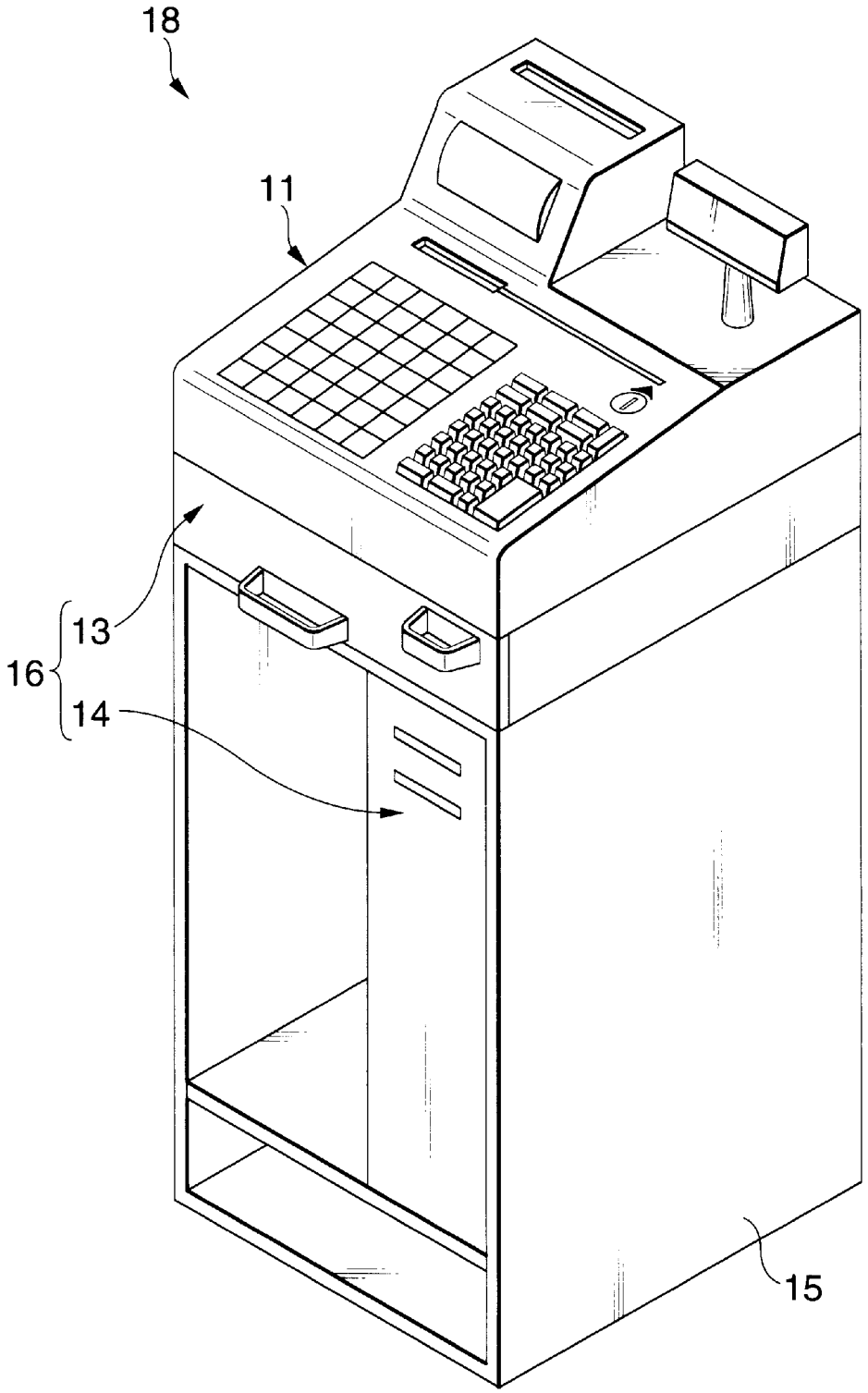
FIG.29 PRIOR ART
FIG. 29 is a perspective view showing a contour of a POS register with an automatically change dispenser.

FIGS. 27(*a*) and 27(*b*) are vertical section side views showing a circulation type bill housing portion of a circulation type bill receiving-paying process portion in a money receiving-paying machine according to a ninth embodiment of the present invention.

The present embodiment also, in order to sum up a total amount of bills in a bill housing portion 110 whenever it is required, has a structure simpler than that of the eighth embodiment. More specifically, in the circular type bill housing portion 110 of the present embodiment is housed a bill circulation identifying sheet (false bill) Q, such as a resin plate excellent in abrasion resistance. As shown in FIG. 27(*a*), when a bill P is discharged from the housing portion 110, although a denomination of the bill is identified at the leaving-bill identifying portion 140, as shown in FIG. 27(*b*), when the bill circulation identifying sheet (false bill) Q is discharged from the housing portion 110, information, such as a code thereof, is identified at the leaving-bill identifying portion 140. Therefore, through identification of an amount of bills discharged during a period from a first discharge of the bill circulation identifying sheet Q to a second discharge thereof, a total amount of the bills housed in the housing portion 110 can be calculated.

In the present embodiment, as a mechanism for closing the bill discharge port 110A as in the eighth embodiment is not required, although there is an advantage such that only the bill circulation identifying sheet Q is sufficient, since a time point when the bill circulation identifying sheet Q is discharged is made a starting point, in case the bill circulation identifying sheet Q is located on an upper side of the stacked bills in the housing portion 110, it takes a slightly longer time to confirm the housed bill amount.

As described hereinabove, the money receiving-paying machine according to the present invention is characterized by an integral type structure, arranged side by side, formed of a circulation type bill receiving-paying process portion wherein, in use of a single circulation type bill housing portion for housing bills regardless of their denominations, in case a bill which is not required for payment is discharged from the housing portion, the bill is returned to a received bill transferring portion through a returning-bill transferring portion diverged from a first changeover gate to thereby be housed in the housing portion again; and a circulation type coin receiving-paying process portion wherein rotation type coin receiving cylinders disposed in an inclined state or substantially horizontal state are employed as a coin housing system. Therefore, the following advantages can be obtained.

(1) A thin and compact money receiving-paying machine having approximately the same dimension as that of a cash drawer box can be obtained. Also, since rotation type coin receiving cylinders are used, a high speed for housing or discharging coins can be attained.

(2) In case a spiral coin feed protruding strip is formed on an inner surface of a rotation type coin receiving cylinder, coins can be housed quickly and positively in an upright state.

(3) Especially, in case a coin feed protruding strip comprises a first coin feed protruding strip and a second coin feed protruding strip adjacent thereto with a phase difference of less than 180° on a coin receiving port side from the first coin feed protruding strip, coins can be changed to an upright state without difficulties.

(4) In case a plurality of rotation type coin receiving cylinders for different denominations is disposed in a horizontally crossing direction of a case and arranged side by side toward an inner side of the case; coin receiving ports at upper side edges of the respective rotation type coin receiving cylinders are disposed on a side of a received coin transferring portion extending from a front portion to a back direction; and coin discharging ports at lower side edges of the respective rotation type coin receiving cylinders are disposed on a side of the paying-coin transferring portion extending from a back portion to a front direction, it is not necessary to provide a coin sorting portion on a back side of a device, and the coin sorting portion can be provided along the received coin transferring portion extending from a front portion to a back direction, so that an occupying space for the circulation type coin receiving-paying process portion can be reduced.

(5) Especially, there can be employed a structure wherein the received-coin transferring portion is disposed on a side of circulation type bill receiving-paying process portion, and the paying-coin transferring portion is disposed on a side of a side wall of the case. Since a bill receiving port and a coin receiving port can be arranged on right and left sides on a front portion of the device, respectively, operation of the money receiving process can be improved.

(6) In case there is employed an upright coin discharging portion for discharging housed coins in an upright state synchronously with rotation of the rotation type coin receiving cylinder, a discharging operation of the coins can be accelerated and at the same time an occupying space of the coin discharging portion can be reduced.

(7) By employing a narrow width coin transferring portion for transferring the discharged upright coins in the upright state, an occupying space of a paying-coin transferring portion can be reduced.

(8) Although the narrow width coin transferring portion is formed of a coin transfer belt for constituting a moving path floor and left-right side plates provided on both side edges of the belt, in case the coin transfer belt is provided with coin-rotation preventing projections on its surface, a transferring speed to a coin paying port can be shortened to thereby accelerate the paying process.

(9) In a circulation type bill receiving-paying device, in case a bill short-side transferring system for transferring bills in a bill short-side direction is employed, a bill transferring path becomes short, and further since a space between the respective bill process portions is shortened, the device can be made compact. Furthermore, since a one-cycle time for returning a bill to a housing portion through a returning-bill transferring portion can be shortened, even if a circulation type bill housing portion regardless of bill denominations is used, the bill processing speed can not be lowered.

(10) In a structure wherein a leaving-bill separating and transferring portion has a kick roller for frictionally contacting the back side of each bill stacked in a circulation type bill housing portion to discharge the bill in an inner direction along its surface, and a leaving-bill transferring portion has a turning-direction changing path for turning downward at an inner position and then bringing forward the bill discharged from the leaving-bill separating and discharging portion, a round path extending one above another can make the circulation type bill receiving-paying portion further compact.

(11) In a structure including a second changeover gate for distributing a bill from a first changeover gate to either a second paying-bill transferring portion communicating with a second bill paying port at a front position thereof or a returning-bill transferring portion, low denomination bills can be discharged to a first bill paying port and high denomination bills can be discharged to the second bill paying port. In case the high denomination bills which are not needed as a change are removed from the housing portion to thereby make a discharge adjustment, the second bill paying port can also be used.

(12) In case the second paying-bill transferring portion functions as a paying-bill immediate-before holding portion for holding bills to be discharged to the second bill paying port, a high denomination bill can be discharged instantly.

(13) In case a second bill housing portion is employed instead of the second bill paying port, high denomination bills are removed from the circulation type bill housing portion and transferred to the second bill housing portion to be housed therein, so that excessive bills are hardly housed in the circulation type bill housing portion to thereby increase receiving process time.

(14) In case the second bill housing portion can be locked, the high denomination bills can be safely housed.

(15) Further, in case there is provided a third changeover gate for distributing a bill from the first changeover gate between the first changeover gate and the second changeover gate of the returning-bill transferring portion to either the third paying-bill transferring portion communicating with the first bill paying port or the returning-bill transferring portion communicating with the merging point, high denomination bills can also be discharged to the first bill paying port, so that a plurality of bill paying ports is not required and bill management can be easily carried out.

(16) In case the third paying-bill transferring portion constitutes a paying bill immediate-before holding portion for holding bills to be discharged to the first bill paying port, since high denomination bills can be held in the third paying-bill transferring portion, the high denomination bills can be paid faster than low denomination bills to the first bill paying port, so that payment can be made in a state where the low denomination bills are stacked on the high denomination bills discharged earlier.

(17) In case a bill receiving port is a bill inserting portion capable of receiving plural denomination bills in a gathered state, and there is provided a received bill separating-discharging portion disposed between the bill inserting portion and a received-bill transferring portion to separate one by one the gathered bills received at the bill inserting portion and transfer to the received-bill transferring portion, even if the plural bills are inserted at the same time, after the bills are separated one by one by the received bill separating-discharging portion, they are received in the housing portion through the received bill transferring portion. Therefore, received bill process can be accelerated.

(18) In a structure including a received bill identifying portion for identifying denominations of the bills separated at the received bill separating-discharging portion, and a fourth changeover gate for distributing the bills from the received-bill identifying portion in the middle of the received-bill transferring portion to either a rejected-bill transferring portion communicating with a rejecting port or a rejecting portion provided at the front position, or the received-bill transferring portion communicating with the merging point, in case a bill which can not be identified is inserted, the received-bill identifying portion detects the bill and returns it to the reject port or rejecting portion through the fourth changeover gate and the rejected-bill transferring portion. Therefore, false bills can be dealt quickly.

(19) In a structure including a received-bill re-discharge rejecting mechanism for closing a path for sending out the bills stacked higher than a reference surface in the circulation type bill housing portion, a total amount of the bills received in the housing portion can be summed up, so that when an operator of the device is changed, the total amount of the bills housed in the housing portion and a displayed amount can be collated.

(20) In a structure including a bill circulation identifying sheet stacked on the bills housed in the circulation type bill housing portion, also, the total amount of the bills housed in the housing portion can be summed up. When compared with the case where the received-bill re-discharge rejecting mechanism is provided, a functional system can be simplified.

(21) In case a money receiving-paying process unit wherein a circulation type bill receiving-paying process portion and a circulation type coin receiving-paying process portion are mounted on a base fame, and at least a bill receiving port, a first bill paying port, a coin receiving port and a coin paying port are formed on a front panel, has a drawer-type structure capable of being inserted into and drawn out of a case in a front-rear direction, since the money receiving-paying process unit can be easily drawn out of the case to be exposed, problems occurred in the process portions can be quickly inspected.

What is claimed is:

1. A money receiving-paying machine comprising:

a circulation type bill receiving-paying process portion including a bill receiving port and a first bill paying port provided on a front position; a received-bill transferring portion for transferring bills inserted into the bill receiving port; a circulation type bill housing portion for sequentially housing the transferred bills by piling up orderly regardless of their denominations; a leaving-bill separating and discharging portion for separating and discharging said bills one by one from said housing portion; a leaving-bill transferring portion for transferring the discharged bills; a leaving-bill identifying portion for identifying denominations of the bills to be transferred in a middle of said leaving-bill transferring portion; a first paying-bill transferring portion for guiding to the first bill paying port; a returning-bill transferring portion to be merged with the received-bill transferring portion; and a first changeover gate for distributing a bill corresponding to an identification result at the leaving-bill identifying portion to one of the first paying-bill transferring portion and the returning-bill transferring portion, and a circulation type coin received-paying process portion situated at a side of the bill receiving-paying process portion including a coin receiving port and a coin paying port disposed at a front position; a received-coin transferring portion for transferring a plurality of coins thrown at a same time into the coin receiving port; a coin sorting portion for sorting the transferring coins according to denominations; rotation type coin receiving cylinders positioned in an inclined state or substantially horizontal state for housing the sorted coins according to the denominations therein to be arranged orderly in an upright state, each rotation type coin receiving cylinder having a spiral coin feed protruding strip on an inner peripheral surface thereof; coin discharging portions for discharging the upright coins one by one to an outside of the rotation type coin receiving cylinders; and a paying-coin transferring portion for transferring the coins discharged from the respective coin discharging portions to the coin paying port.

2. A money receiving-paying machine according to claim 1, wherein said coin feed protruding strip includes a first coin feed protruding strip and a second coin feed protruding strip adjacent thereto on a side of a coin receiving port with a phase difference of less than 180° from the first coin feed strip.

3. A money receiving-paying machine according to claim 1, wherein said plural rotation type coin receiving cylinders according to the denominations are disposed to cross a case in a horizontal direction and aligned side by side in an inner direction; coin receiving ports at upper side edges of the rotation type coin receiving cylinders are positioned on a side of the received-coin transferring portion extending from a front portion to a back direction; and coin discharging ports at lower side edges of the rotation type coin receiving cylinders are positioned on a side of the paying-coin transferring portion extending from a back portion to a front direction.

4. A money receiving-paying machine according to claim 1, wherein said received-coin transferring portion is located on a side of said circulation type bill receiving-paying process portion, and said paying-coin transferring portion is located on a side of a side wall of a case.

5. A money receiving-paying machine according to claim 1, wherein said coin discharging portions comprise upright-coin discharging portions for discharging the housed coins in an upright state synchronously with rotations of said rotation type coin receiving cylinders.

6. A money receiving-paying machine according to claim 4, wherein said paying-coin transferring portion comprises a narrow width coin transferring portion for transferring in the upright state the upright coins discharged from said paying-coin discharging portions.

7. A money receiving-paying machine according to claim 1, wherein said narrow width coin transferring portion comprises a coin transfer belt for constituting a moving path floor and side plates provided on both sides of said belt.

8. A money receiving-paying machine according to claim 1, wherein said coin transferring belt includes coin-rotation preventing projections on a surface thereof.

9. A money receiving-paying machine according to claim 1, wherein said circulation type bill receiving-paying device includes a short-side transferring system for transferring the bills in a short-side direction thereof.

10. A money receiving-paying machine according to claim 1, wherein said leaving-bill separating and discharging portion includes a kick-out roller for kicking out bills stacked in said circulation type bill housing portion to an inner direction by frictionally contacting backsides thereof, and said leaving-bill transferring portion includes a turning-direction changing path for turning downward at an inner position the bills discharged from said leaving-bill separating and discharging portion and sending back forward.

11. A money receiving-paying machine according to claim 1, further comprising a second changeover gate for distributing a bill from said first changeover gate in a middle of said returning-bill transferring portion to one of a second paying-bill transferring portion communicating with a second bill paying port provided at the front position and the returning-bill transferring portion communicating with said merging point.

12. A money receiving-paying machine according to claim 11, wherein said second paying-bill transferring portion comprises a paying-bill immediate-before holding portion for holding bills to be discharged to the second bill paying port.

13. A money receiving-paying machine according to claim 1, wherein said bill receiving port comprises a bill insertion portion capable of receiving plural bills of different denominations in a gathered state, and between the bill insertion portion and the received-bill transferring portion is provided a received bill separating and discharging portion for discharging to the received-bill transferring portion by separating and discharging one by one the bills inserted into the bill insertion portion in the gathered state.

14. A money receiving-paying machine according to claim 13, further comprising a received-bill identifying portion for identifying denominations of the bills separated at the received-bill separating and discharging portion, and another changeover gate for distributing bills from the received bill identifying portion in a middle of the received-bill transferring portion to either a rejected-bill transferring portion communicating with a reject port or a reject bill housing portion provided at a front position or the received-bill transferring portion communicating with a merging point.

15. A money receiving-paying machine according to claim 1, wherein a money receiving-paying process unit is constructed such that the circulation type bill receiving-paying process portion and the circulation type coin receiving-paying process portion are mounted on a base frame, and at least the bill receiving port, the first bill paying port, the coin receiving port and a coin paying port are arranged on a front panel thereof, said process unit being drawn out of and inserted into the case in a front-rear direction.

16. A money receiving-paying machine comprising:

a circulation type bill receiving-paying process portion including a bill receiving port and a first bill paying port provided on a front position; a received-bill transferring portion for transferring bills inserted into the bill receiving port; a circulation type bill housing portion for sequentially housing the transferred bills by piling up orderly regardless of their denominations; a leaving-bill separating and discharging portion for separating and discharging said bills one by one from said housing portion; a leaving-bill transferring portion for transferring the discharged bills; a leaving-bill identifying portion for identifying denominations of the bills to be transferred in a middle of said leaving-bill transferring portion; a first paying-bill transferring portion for guiding to the first bill paying port; a returning-bill transferring portion to be merged with the received-bill transferring portion; and a first changeover gate for distributing a bill corresponding to an identification result at the leaving-bill identifying portion to one of the first paying-bill transferring portion and the returning-bill transferring portion; a second bill housing portion communicating with a second housing bill transferring portion and including a bill housing portion provided with a lock; a second changeover gate for distributing bills from the first changeover gate in the middle of the returning-bill transferring portion to one of the second housing bill transferring portion communicating with the second bill housing portion and the returning bill transferring portion communicating with a merging point, and a circulation type coin received-paying process portion situated at a side of the bill receiving-paying process portion including a coin receiving port and a coin paying port disposed at a front position; a received-coin transferring portion for transferring a plurality of coins thrown at a same time into the coin receiving port; a coin sorting portion for sorting the transferring coins according to denominations; rotation type coin receiving cylinders positioned in an inclined state or substantially horizontal state for housing the sorted coins according to the denominations therein to be arranged orderly in an upright state; coin discharging portions for discharging the upright coins one by one to an outside of the rotation type coin receiving cylinders; and a paying-coin transferring portion for transferring the coins discharged from the respective coin discharging portions to the coin paying port.

17. A money receiving-paying machine according to claim 16, further comprising a third changeover gate provided between the first changeover gate and the second changeover gate of the returning-bill transferring portion to distribute bills from the first changeover gate to one of a third paying-bill transferring portion communicating with the first bill paying port and the returning-bill transferring portion communicating with the merging point.

18. A money receiving-paying machine according to claim 17, wherein said third paying bill transferring portion comprises a paying bill immediate-before holding portion for holding bills to be discharged to the first bill paying port.

19. A money receiving-paying machine comprising:

a circulation type bill receiving-paying process portion including a bill receiving port and a first bill paying port provided on a front position; a received-bill transferring portion for transferring bills inserted into the bill receiving port; a circulation type bill housing portion for sequentially housing the transferred bills by piling up orderly regardless of their denominations; a re-discharge rejecting device of the received bills for closing a bill-leaving path of the bills stacked higher than a reference surface in the circulation type bill housing portion; a leaving-bill separating and discharging portion for separating and discharging said bills one by one from said housing portion; a leaving-bill transferring portion for transferring the discharged bills; a leaving-bill identifying portion for identifying denominations of the bills to be transferred in a middle of said leaving-bill transferring portion; a first paying-bill transferring portion for guiding to the first bill paying port; a returning-bill transferring portion to be merged with the received-bill transferring portion; and a first changeover gate for distributing a bill corresponding to an identification result at the leaving-bill identifying portion to one of the first paying-bill transferring portion and the returning-bill transferring portion, and a circulation type coin received-paying process portion situated at a side of the bill receiving-paying process portion including a coin receiving port and a coin paying port disposed at a front position; a received-coin transferring portion for transferring a plurality of coins thrown at a same time into the coin receiving port; a coin sorting portion for sorting the transferring coins according to denominations; rotation type coin receiving cylinders positioned in an inclined state or substantially horizontal state for housing the sorted coins according to the denominations therein to be arranged orderly in an upright state; coin discharging portions for discharging the upright coins one by one to an outside of the rotation type coin receiving cylinders; and a paying-coin transferring portion for transferring the coins discharged from the respective coin discharging portions to the coin paying port.

20. A money receiving-paying machine according to claim 19, wherein said re-discharge rejecting device comprises a shutter member which is mounted on the bills stacked in the circulation type bill housing portion and descends through discharge operations of the stacked bills of the leaving-bill separating and discharging portion for discharging the bills stacked under the reference surface so that the bill discharge port is closed, and a shutter driving device for driving the retreating shutter member.

21. A money receiving-paying machine comprising:

a circulation type bill receiving-paying process portion including a bill receiving port and a first bill paying port provided on a front position; a received-bill transferring portion for transferring bills inserted into the bill receiving port; a circulation type bill housing portion for sequentially housing the transferred bills by piling up orderly regardless of their denominations; a leaving-bill separating and discharging portion for separating and discharging said bills one by one from said housing portion; a leaving-bill transferring portion for transferring the discharged bills; a leaving-bill identifying portion for identifying denominations of the bills to be transferred in a middle of said leaving-bill transferring portion; a first paying-bill transferring portion for guiding to the first bill paying port; a returning-bill transferring portion to be merged with the received-bill transferring portion; and a first changeover gate for distributing a bill corresponding to an identification result at the leaving-bill identifying portion to one of the first paying-bill transferring portion and the returning-bill transferring portion, a bill-circulation identifying sheet to be stacked on the bills in the circulation type bill housing portion, and a circulation type coin received-paying process portion situated at a side of the bill receiving-paying process portion including a coin receiving port and a coin paying port disposed at a front position; a received-coin transferring portion for transferring a plurality of coins thrown at a same time into the coin receiving port; a coin sorting portion for sorting the transferring coins according to denominations; rotation type coin receiving cylinders positioned in an inclined state or substantially horizontal state for housing the sorted coins according to the denominations therein to be arranged orderly in an upright state; coin discharging portions for discharging the upright coins one by one to an outside of the rotation type coin receiving cylinders; and a paying-coin transferring portion for transferring the coins discharged from the respective coin discharging portions to the coin paying port.

* * * * *

UNITED STATES PATENT AND TRADEMARK OFFICE

CERTIFICATE OF CORRECTION

PATENT NO. : 6,003,652

DATED : December 21, 1999

INVENTOR(S) : Susumu Murata, et al.

It is certified that error appears in the above-identified patent and that said Letters Patent is hereby corrected as shown below:

In column 7, line 2, delete "which";

In column 11, line 59, change "rear of" to --near--;

In column 17, line 18, delete "S, S";

In column 23, line 12, change "forth" to --fourth--;

line 40, change "2a" to --2A--;

In column 31, line 14, change "1" to --6--;

line 18, chnge "1" to --7--;

In column 32, line 5, change "a" to --the--; and line 7, change "the" to --a--.

Signed and Sealed this

Eighth Day of August, 2000

*Attest:*

Q. TODD DICKINSON

*Attesting Officer*

*Director of Patents and Trademarks*